US010486021B2

(12) United States Patent
Hicks, II

(10) Patent No.: US 10,486,021 B2
(45) Date of Patent: Nov. 26, 2019

(54) STRENGTH AND FITNESS EXERCISE MACHINE

(71) Applicant: John R. Hicks, II, Murrells Inlet, SC (US)

(72) Inventor: John R. Hicks, II, Murrells Inlet, SC (US)

( * ) Notice: Subject to any disclaimer, the term of this patent is extended or adjusted under 35 U.S.C. 154(b) by 150 days.

(21) Appl. No.: 15/911,718

(22) Filed: Mar. 5, 2018

(65) Prior Publication Data

US 2019/0269965 A1 Sep. 5, 2019

(51) Int. Cl.

| | |
|---|---|
| ***A63B 23/04*** | (2006.01) |
| ***A63B 21/00*** | (2006.01) |
| ***A63B 21/062*** | (2006.01) |
| *A63B 23/02* | (2006.01) |

(52) U.S. Cl.

CPC ..... *A63B 23/0417* (2013.01); *A63B 21/0628* (2015.10); *A63B 21/154* (2013.01); *A63B 21/4034* (2015.10); *A63B 21/4035* (2015.10); *A63B 21/4045* (2015.10); *A63B 23/02* (2013.01); *A63B 23/0233* (2013.01)

(58) Field of Classification Search

CPC ..... A63B 21/062; A63B 21/0626; A63B 21/0628; A63B 21/154; A63B 21/4034; A63B 21/4035; A63B 21/4045; A63B 2022/0092; A63B 2022/0094; A63B 2023/006; A63B 23/02; A63B 23/0233

See application file for complete search history.

(56) References Cited

U.S. PATENT DOCUMENTS

| | | | | |
|---|---|---|---|---|
| 4,915,378 | A | 4/1990 | Abrahamian et al. | |
| 5,411,458 | A | 5/1995 | Giust | |
| 5,827,154 | A * | 10/1998 | Gill | A63B 21/153 482/9 |
| 6,251,052 | B1 * | 6/2001 | Simonson | A63B 23/0405 482/100 |
| 6,287,241 | B1 | 9/2001 | Ellis | |
| 6,296,596 | B1 * | 10/2001 | Alessandri | A63B 23/03525 482/100 |
| 6,361,479 | B1 | 3/2002 | Hildebrandt et al. | |
| 7,004,891 | B2 | 2/2006 | Morris et al. | |
| 7,052,444 | B2 | 5/2006 | Webber | |
| 7,125,370 | B1 * | 10/2006 | Schaffner | A63B 21/155 482/142 |
| 7,220,221 | B2 | 5/2007 | Mosimann et al. | |
| 7,727,128 | B2 | 6/2010 | Giannelli et al. | |
| 2005/0032611 | A1 | 2/2005 | Webber et al. | |

* cited by examiner

*Primary Examiner* — Megan Anderson

(74) *Attorney, Agent, or Firm* — P. Jeff Martin; The Law Firm of P. Jeffrey Martin, LLC

(57) ABSTRACT

An exercise machine has a main frame which supports and includes a carriage support base, a torso carriage assembly coupled to the carriage support base, an upper torso support slidably coupled to the torso carriage assembly, an adjustable shoulder support slidably coupled to a track assembly, a foot support assembly slidably coupled to a foot support carriage, and an adjustable resistance operably connected with the shoulder support and the upper torso support.

10 Claims, 30 Drawing Sheets

STRENGTH AND FITNESS EXERCISE MACHINE

I. RELATED APPLICATIONS

There are no previously filed, nor currently any co-pending applications, anywhere in the world.

II. FIELD OF THE INVENTION

This application discloses claims and embodiments generally related to exercise equipment and machines, and more particularly, to a strength and fitness exercise machine configured to isolate the lower body, thereby allowing the user to obtain optimized levels of strength, caloric expenditure, and cardiovascular and aerobic fitness during an exercise interval.

III. BACKGROUND OF THE INVENTION

The prior art discloses numerous exercise machines for either strengthening the body, particularly the legs, or for enhancing one's cardiovascular health or aerobic fitness.

However, the prior art fails to teach, suggest, or disclose an exercise machine adapted and configured to target muscles of the lower torso, and which anatomically orients the user in a position biomechanically optimized for achieving comprehensive health and fitness while substantially reducing the risk of injury to the knee joints and lumbar spine.

The present invention is adapted and configured to anatomically orient the user in a position biomechanically optimized for substantially reducing the risk of injury to the knee joints and lumbar spine, and for achieving comprehensive health and fitness. Significantly, the biomechanically optimized position uniquely coincides with user positioned in a natural and athletic position during performance of exercise by the user when operating the machine of the present invention.

Accordingly, a need exists for an improved exercise machine for targeting muscles of the lower torso which anatomically orients the user in a position biomechanically optimized for achieving comprehensive health and fitness while substantially reducing the risk of injury to the knee joints and lumbar spine. The development of the strength and fitness exercise machine of the present application fulfills this need.

A search of the prior art did not disclose any patents that read directly on the claims of the instant invention; however, the following references were considered related:

U.S. Pat. No. 7,727,128 B2, issued in the name of Giannelli et al.;

U.S. Pat. No. 7,052,444 B2, issued in the name of Webber;

U.S. Pat. No. 5,411,458, issued in the name of Giust;

U.S. Pat. No. 6,287,241 B1, issued in the name of Ellis;

U.S. Pat. No. 7,004,891 B2, issued in the name of Morris et al.;

U.S. Pat. No. 7,220,221 B2, issued in the name of Mosimann et al.;

U.S. Pat. No. 6,361,479 B1, issued in the name of Hildebrandt et al.;

U.S. Pat. No. 4,915,378, issued in the name of Abrahamian et al.; and

U.S. Patent application no. 2005/0032611 A1, published in the name of Webber et al.

This application presents claims and embodiments that fulfill a need or needs not yet satisfied by the products, inventions and methods previously or presently available. In particular, the claims and embodiments disclosed herein describe a strength and fitness exercise machine, the machine comprises a main frame comprising a front support section, a central support section, and a rear support section; a carriage support base; a torso carriage assembly mechanically coupled superjacent the carriage support base; an adjustable, inclined upper torso support slidably coupled to the torso carriage assembly; a track assembly; an adjustable shoulder support slidably coupled to the track assembly; a foot support carriage; a foot support assembly; an adjustable resistance operably connected with the shoulder support and the upper torso support via a linking assembly, the exercise machine of the present invention providing unanticipated and nonobvious combination of features distinguished from the devices, apparatuses, inventions and methods preexisting in the art. The applicant is unaware of any device, apparatus, method, disclosure or reference that discloses the features of the claims and embodiments disclosed herein, and as more fully described below.

IV. SUMMARY OF THE INVENTION

A strength and fitness exercise machine designed to target the muscles of the lower torso is disclosed. In accordance with one embodiment of the present invention, the exercise machine comprises a main frame having a front support section, a central support section, and a rear support section, the front support section and the rear support section are integrally joined by the central support section.

The front support section includes a torso carriage assembly mechanically coupled superjacent a carriage support base. An adjustable, inclined upper torso support is slidably coupled to the torso carriage assembly. The upper torso support slidably translates along the torso carriage assembly. The upper torso support includes a cushioned pad, a pad platform, and a pad support substructure.

An adjustable shoulder support is also provided. The shoulder support is slidably coupled to a track assembly.

The central support section comprises a foot support carriage and a foot support assembly. The foot support assembly comprises a foot platform which slidably translates along the foot support carriage.

The rear support section comprises an adjustable resistance, e.g., loadable weight plates or electric resistance, operably connected with the shoulder support and the upper torso support via a linking assembly. In accordance to one embodiment, the linking assembly is a cable and pulley system.

V. BRIEF DESCRIPTION OF THE DRAWING(S)

The advantages and features of the present invention will become better understood with reference to the following more detailed description and claims taken in conjunction with the accompanying drawings, in which like elements are identified with like symbols, and in which:

VI. DETAILED DESCRIPTION OF THE EMBODIMENT(S)

It will be readily understood that the components of the present invention, as generally described and illustrated in the figures herein, may be arranged and designed in a wide variety of different configurations. Thus, the following detailed description of the embodiments of an antimicrobial article, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present invention. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

"Comprehensive health and fitness" as used hereinafter is defined as the simultaneous acquisition of optimized levels of strength, caloric expenditure, and cardiovascular and aerobic fitness collectively.

"Upper torso" as used hereinafter is defined as, and intended to refer to, the area between the user's abdomen and shoulders along the anterior or front side of user's body.

"Lower torso" as used hereinafter is defined as, and intended to refer to area of user's body below user's abdomen, namely the hips, thighs, knees, calves, and feet.

"Hip flexion" as used hereinafter is defined as the anatomical orientation of a person's knee joints relative to the hip joints.

"Prone" as used hereinafter is defined as, and intended to refer to, the position in which a person is laying on his/her stomach or abdomen.

"Umbilicus" as used hereinafter is defined as the navel or belly button.

"Ventral surface" as used hereinafter is defined as, and intended to refer to, the front side of a person.

"Biomechanically optimal range of motion" as used hereinafter is defined as the anatomical range of motion completed by user for one repetition of exercise, whereby in the exercise start position, user has a hip flexion measure of 90°, from which user's legs are extended to a substantially linear position at which user has a hip flexion measure of 0°, and from which user bends legs returning to the start position at which user has a hip flexion measure of 90°.

Figure 1:
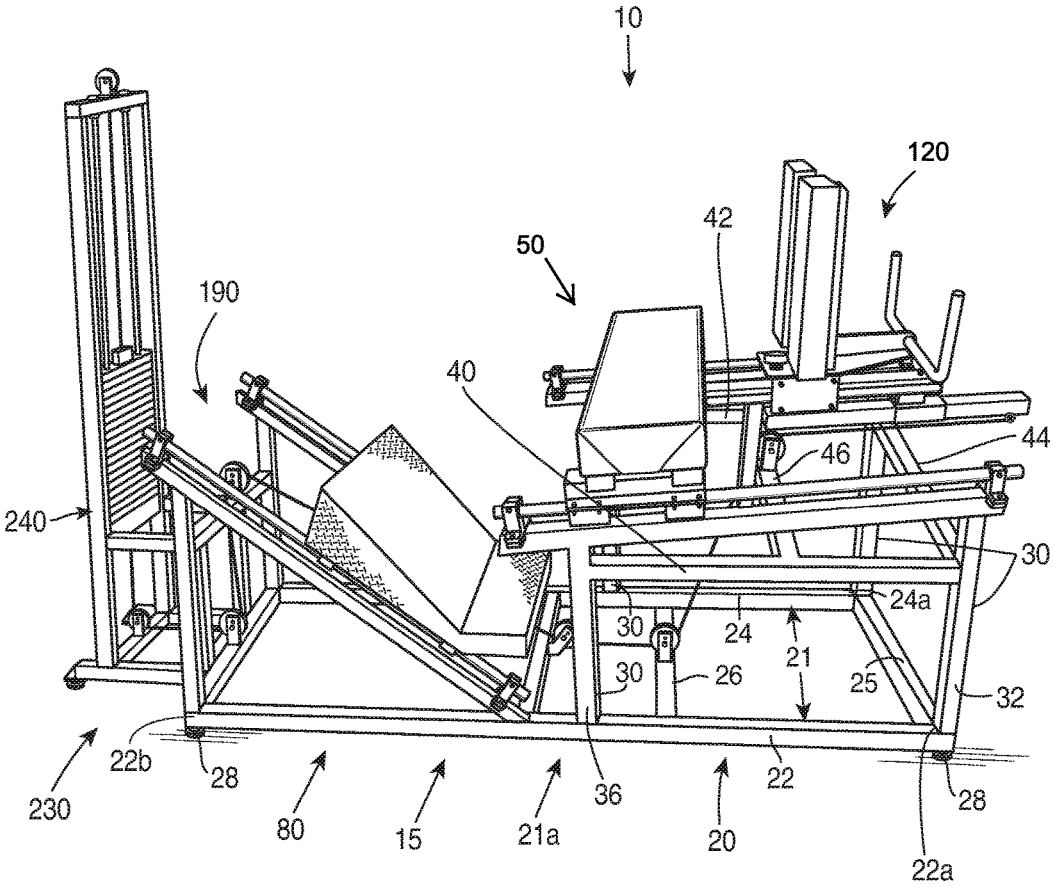
FIG. 1 is a right side perspective view of a strength and fitness exercise machine, in accordance to one embodiment of the present invention.

Referring now to FIG. 1, a strength and fitness exercise machine, generally designated at 10 is disclosed, in accordance to one embodiment of the present invention. The strength and fitness exercise machine 10, hereinafter "machine 10", is designed to target the muscles of the lower torso when performing the exercise. The exercise is performed through the biomechanically optimal range of motion. The machine 10 is adapted and configured to maximize the user's ability to obtain optimized levels of strength, caloric expenditure, and cardiovascular and aerobic fitness when using the machine 10 to perform the exercise. Regular use of the machine of the present invention allows the user to maintain an active and healthy lifestyle.

When combined with an exercise protocol prescribed or developed by a licensed medical, rehabilitation or fitness specialist to meet the specific needs of each patient or user individually, the machine 10 is further adapted and configured to allow the user thereof to maximize user's ability to simultaneously obtain optimized levels of strength, caloric expenditure, and cardiovascular and aerobic fitness during an exercise session efficiently and in a manner being substantially less prone to injury.

In further reference to the above-mentioned prescribed exercise protocol, it is envisioned that the prescribed protocol would be developed by a licensed medical, rehabilitation or fitness specialist for the user/patient. Thus, in light of the specific and unique needs and interests of the user/patient, the goal of the exercise prescription requires the successful integration of exercise principles and the machine 10 of the present invention.

The machine 10 is designed and configured such that when using the machine to exercise, the machine 10 uniquely enables the user to be anatomically oriented in the most biomechanically optimized position for achieving comprehensive health and fitness. The use of the machine 10 further allows the user to benefit from enhanced strength and cardiovascular health in a manner which substantially reduces the risk of injury to the knee joints and lumbar spine. The machine 10 is adapted and configured to substantially limit biomechanical joint stress on the user's knees and lumbar spine while user engages the biomechanically optimal range of motion of user's hip and knee joints during performance of exercise using the machine 10.

The machine 10 includes an adjustable inclined upper torso support and an adjustable shoulder support to accommodate a user's specific body size and shape.

The machine 10 is further adapted and configured to target the muscles of the lower torso, namely, quadriceps, gluteus maximus, pelvic stabilizer, hamstrings, and gastrocnemius muscles.

Figure 2:
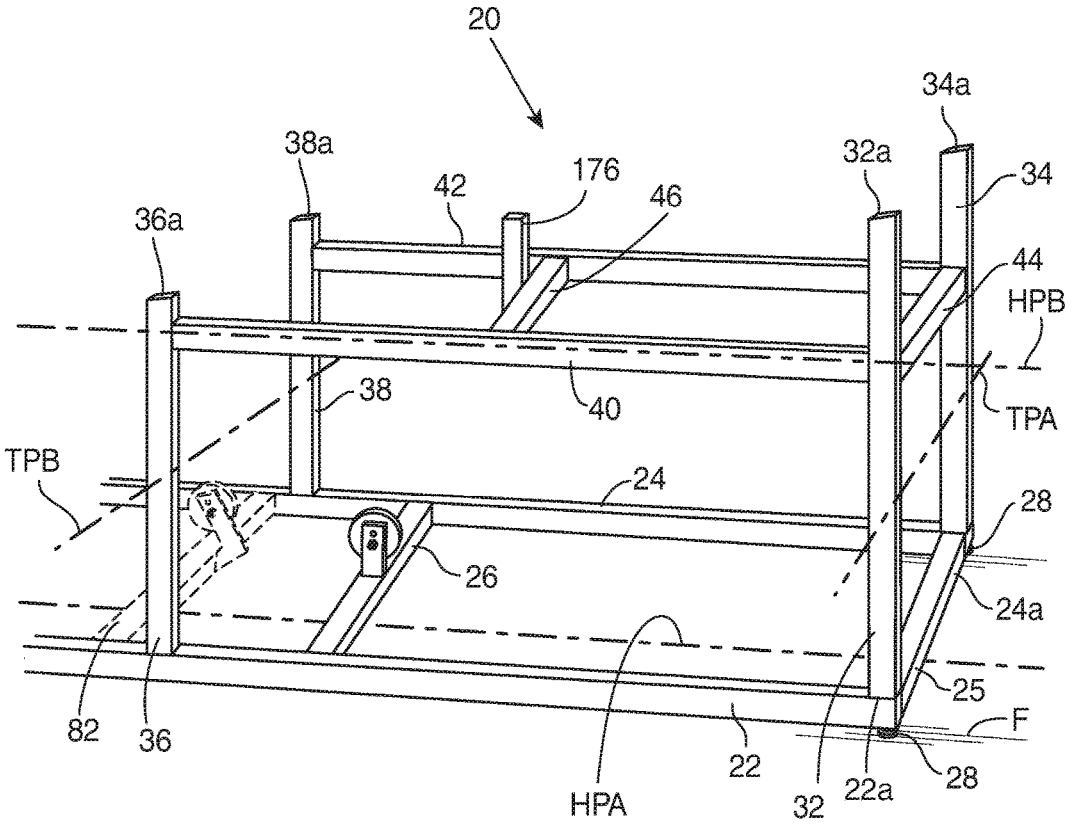
FIG. 2 is a right side perspective view of the front support section of the main frame of FIG. 1, in accordance to one embodiment of the present invention.
Figure 3:
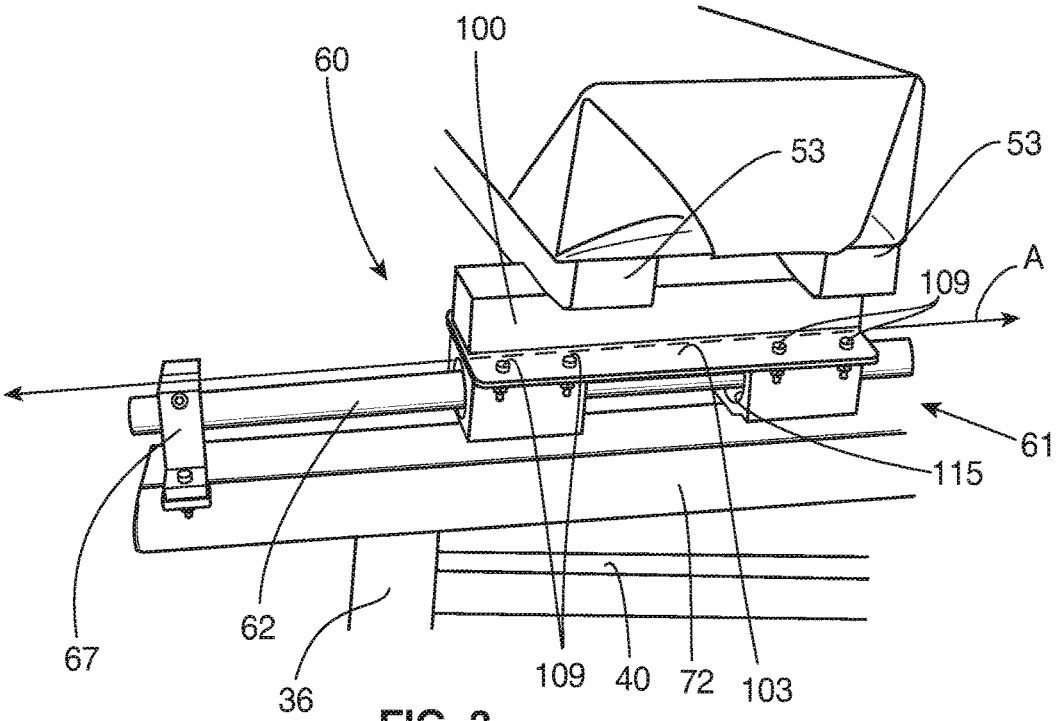
FIG. 3 is a partial right side perspective view of an upper torso support and a torso carriage assembly, in accordance to one embodiment of the present invention.

Referring now more particularly to FIGS. 1 and 2, the machine 10 comprises a main frame 15 comprising a front support section 20 and a rear support section 230. The front support section 20 and rear support section 230 are integrally joined by a central support section 80. Preferably, the main frame 15 is constructed of tubular steel, but may also be made from steel in various stock forms such as plate stock and angle stock. The front support section 20 and central support 80 jointly comprise a pair of linearly elongated, tubular horizontal members 21 comprising a first linearly elongated tubular horizontal member 22 and a second linearly elongated tubular horizontal member 24, wherein the tubular horizontal members 22 and 24 providing a base structure 21*a*. Horizontal members 22 and 24 are coplanar and spatially aligned. Adjustable feet 28 or footers may be provided along lower sidewalls of the horizontal members 22 and 24 at respective forward ends 22*a*, 24*a* and rear ends 22*b*, 24*b*, thereof. The adjustable feet 28 allow the horizontal members 22 and 24 to lay in a plane parallel to and spaced above the floor (F), ground or other flat surface upon which the machine 10 is supported. Footers, on the other hand, may be provided for mounting the horizontal members 22 and 24, and thus the machine 10, to the floor F.

The front support section 20 further comprises a first lower tubular crossmember 25 and a second lower tubular crossmember 26, the first lower crossmember 25 is securably mounted, such as by arc welding, between respective inner sidewalls of the first horizontal member 22 and second horizontal member 24 at forward ends 22*a* and 24*a*, respectively, thereof. The second lower crossmember 26 is securably mounted, such as by arc welding, between respective inner sidewalls of the first horizontal member 22 and second horizontal member 24, distal to the first lower crossmember 25. The first horizontal member 22, second horizontal member 24, first lower tubular crossmember 25, and second lower tubular crossmember 26 are coplanar and lie in a horizontal plane HPA parallel to the floor F or other flat surface upon which the machine 10 is supported.

The front support section 20 further comprises a plurality of tubular vertical members 30 comprising a first vertical member 32, a second vertical member 34, a third vertical member 36, and a fourth vertical member 38. The first vertical member 32 is securably mounted, such as by arc welding, to an upper sidewall of the first horizontal member 22 at the forward end 22*a* thereof. The second vertical member 34 is securably mounted, such as by arc welding, to an upper sidewall of the second horizontal member 24 at the forward end 24*a* thereof. The first and second vertical members 32 and 34 are oriented perpendicular to the first lower crossmember 25. The first and second vertical members 32 and 34 extend vertically along a first transverse plane TPA. The first and second vertical members 32 and 34 are of equal height. Both the first and second vertical members 32 and 34 each comprises a beveled continuous upper edge 32*a* and 34*a*, respectively.

The third vertical member 36 is securably mounted, such as by arc welding, to the upper sidewall of the first horizontal member 22. Third vertical member 36 lies distal to the first vertical member 32, and rearward to second lower crossmember 26. The fourth vertical member 38 is securably mounted, such as by arc welding, to the upper sidewall of the second horizontal member 24. Fourth vertical member 38 lies distal to the second vertical member 34, and rearward to second crossmember 26. The third and fourth vertical members 36 and 38 extend vertically along a second transverse plane TPB, the second transverse plane TPB is parallel to and spaced distal to the first transverse plane TPA. The third and fourth vertical members 36 and 38 are of equal height. The height measure of the first and second vertical members 32 and 34 is greater than the height measure of the third and fourth vertical members 36 and 38. Both the third and fourth vertical members 36 and 38 each comprises a beveled continuous upper edge 36*a* and 38*a*, respectively.

The front support section 20 further comprises a first tubular brace member 40, a second tubular brace member 42, a first upper tubular crossmember 44 and a second upper tubular crossmember 46. The first tubular brace member 40 is securably mounted, such as by arc welding, orthogonally between the first vertical member 32 and the third vertical member 36. The second tubular brace member 42 is securably mounted, such as by arc welding, orthogonally between the second vertical member 34 and the fourth vertical member 38.

The first upper crossmember 44 is securably mounted, such as by arc welding, between respective inner sidewalls of the first vertical member 32 and second vertical member 34, distally above the first lower crossmember 25. The second upper crossmember 46 is securably mounted, such as by arc welding, between respective inner sidewalls of the first brace member 40 and the second brace member 42, about an elongated centerline of the first brace member 40 and second brace member 42. A vertically-extending stop member 176 is securably mounted, such as by arc welding, to a rearward sidewall of the second upper crossmember 46. The first brace member 40, the second brace member 42, the first upper crossmember 44, and the second upper crossmember 46 are coplanar and lie in a horizontal plane HPB parallel to and spaced above the first horizontal member 22, second horizontal member 24, first lower tubular crossmember 25, and second lower tubular crossmember 26.

Figure 6:
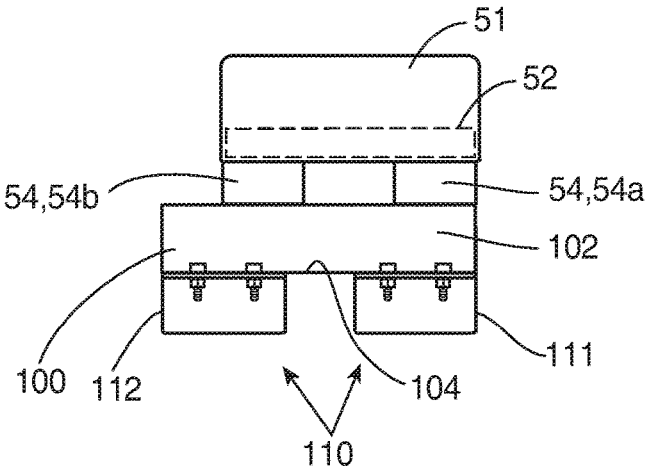
FIG. 6 is a partial right side elevational view of a cushioned pad, a pad platform, and a pad support substructure of the upper torso support in FIG. 3, in accordance to one embodiment of the present invention.
Figure 4:
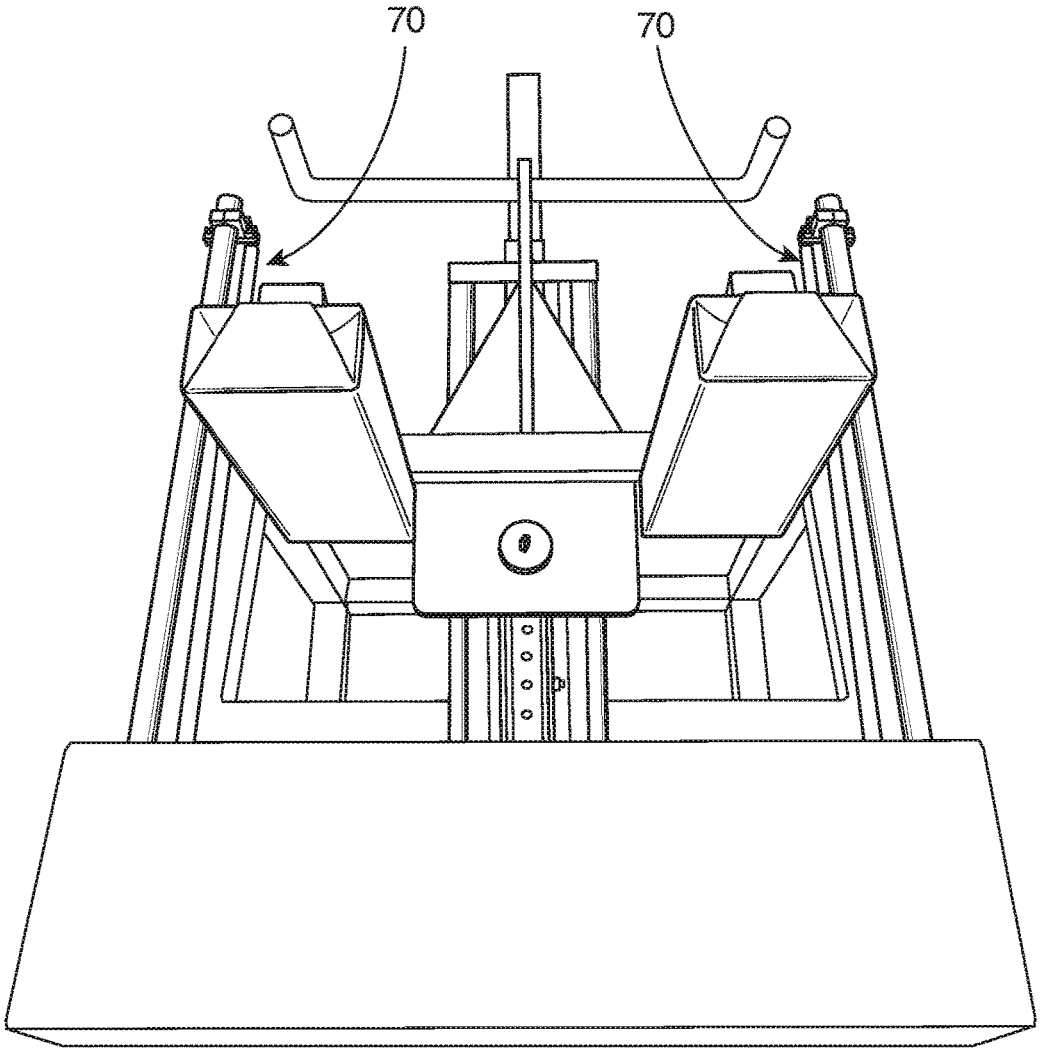
FIG. 4 is a top view of front support section of the main frame illustrating the carriage support base, in accordance to one embodiment of the present invention.
Figure 5:
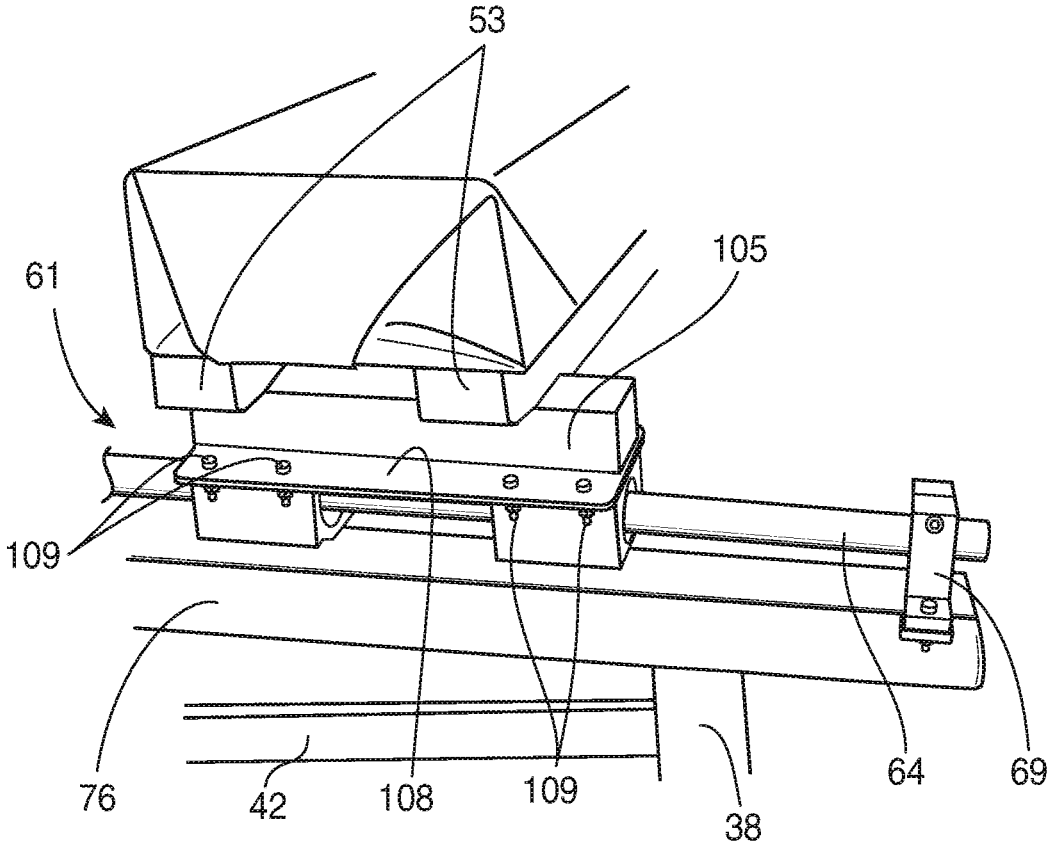
FIG. 5 is a partial left side perspective view of the upper torso support and torso carriage assembly of FIG. 3.
Figure 7:
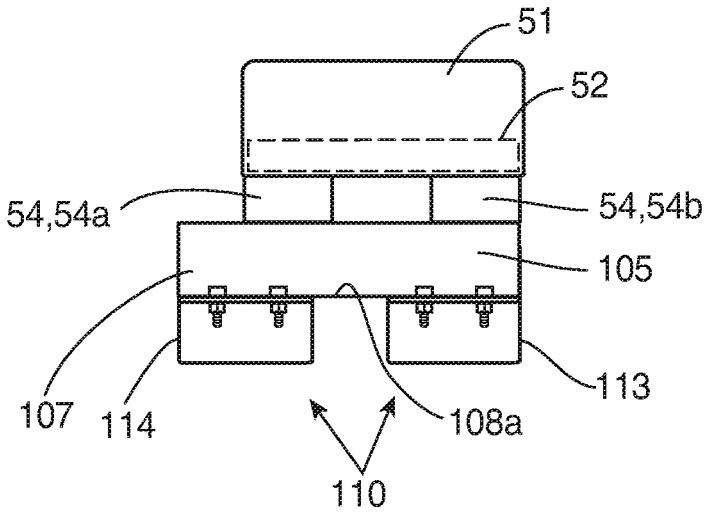
FIG. 7 is a partial left side elevational view of the cushioned pad, pad platform, and pad support substructure of the upper torso support in FIG. 5.
Figure 8:
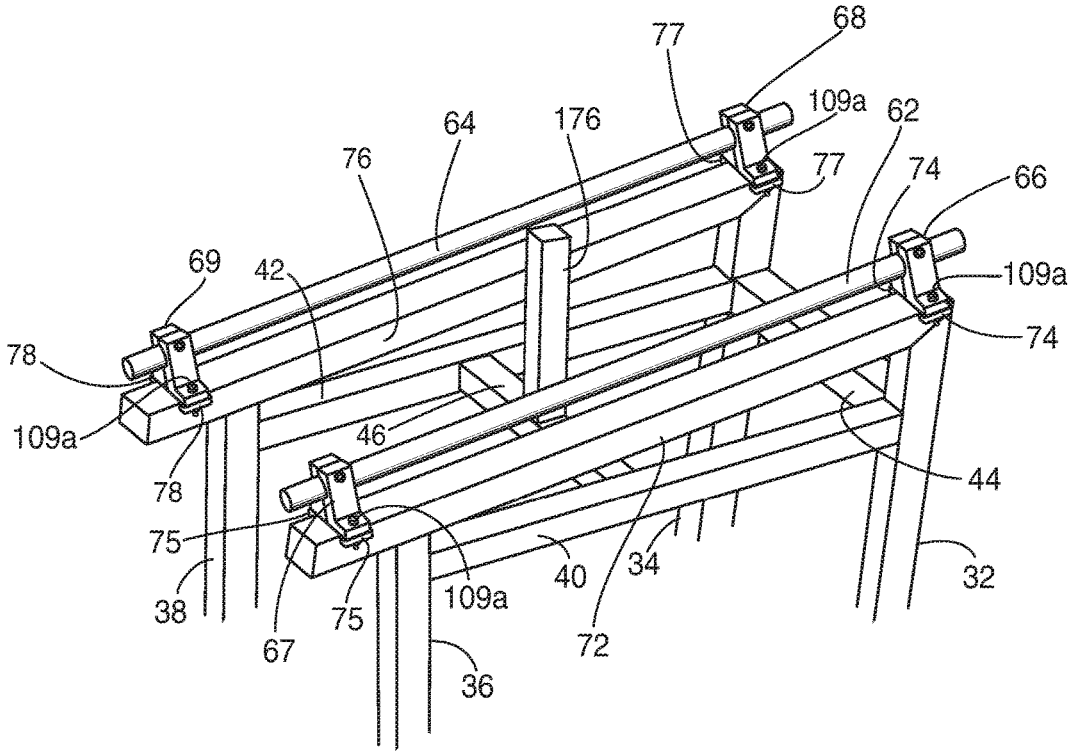
FIG. 8 is a right perspective view of a torso carriage assembly mechanically coupled superjacent a carriage support base, in accordance to one embodiment of the present invention.

Referring now to FIGS. 1, 3, 5, 6, and 7, the front support section 20 further includes an adjustable, inclined upper torso support 50 comprising a cushioned pad 51 overlying a pad platform 52. The upper torso support 50 is mechanically coupled to a torso carriage assembly 60 enabling the upper torso support 50 to slidably translate bi-directionally in a linear, sloped or inclined path. The torso carriage assembly 60 is mechanically coupled superjacent a carriage support base 70. In accordance to one embodiment, the upper torso support 50 comprises a cushioned pad 51, a pad platform 52, and a pad support substructure 53 depicted as pad support members 54 (forward pad support member 54*a* and rearward pad support member 54*b*) mounted to an underside of pad platform 52. The pad platform 52 is suitably mounted to an underside of cushioned pad 51. As best shown in FIGS. 6 and 7, the pad support members 54*a* and 54*b* are aligned in a parallel orientation.

Referring now to FIGS. 4, and 8-11, the carriage support base 70 comprises a first elongated torso support member and a second elongated torso support member 76. The first torso support member 72 comprises a first and second pair of flanges 74 and 75 which provide mounting platforms for guide rod support brackets 66 and 67 (to be described later in greater detail). The second torso support member 76 comprises a first and second pair of flanges 77 and 78 which provide mounting platforms for guide rod support brackets 68 and 69 (to be described later in greater detail). In reference to the flanges 74 and 75 of first torso support member 72, the first pair of flanges 74 flanks the lateral sidewalls of the first torso support member 72 proximate a forward end thereof. The first pair of flanges 74 projects outwardly in an integral fashion from the lateral sidewalls of member 72. The first pair of flanges 74 has upper surfaces which are coplanar with the upper sidewall of the first torso support member 72. The second pair of flanges 75 flanks the lateral sidewalls of the first torso support member 72 proximate a rearward end thereof. The second pair of flanges 75 projects outwardly in an integral fashion from the lateral sidewalls of member 72. The second pair of flanges 75 has upper surfaces which are coplanar with the upper sidewall of the first torso support member 72.

In reference to the flanges 77 and 78 of second torso support member 76, the first pair of flanges 77 flanks the lateral sidewalls of the second torso support member 76 proximate a forward end thereof. The first pair of flanges 77 projects outwardly in an integral fashion from the lateral sidewalls of member 76. The first pair of flanges 77 has upper surfaces which are coplanar with the upper sidewall of the second torso support member 76. The second pair of flanges 78 flanks the lateral sidewalls of the second torso support member 76 proximate a rearward end thereof. The second pair of flanges 78 projects outwardly in an integral fashion from the lateral sidewalls of member 76. The second pair of flanges 78 has upper surfaces which are coplanar with the upper sidewall of the second torso support member 76.

Figure 10:
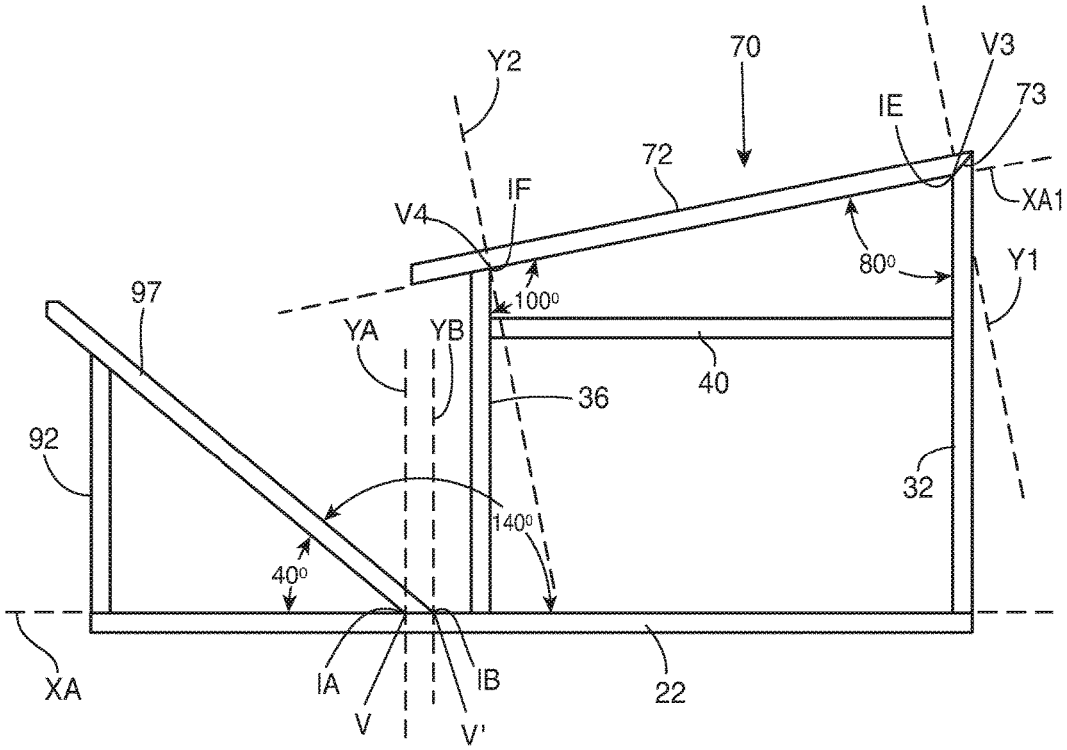
FIG. 10 is a right side elevational view of the front support section and the central support section of the main frame, in accordance to one embodiment of the present invention.
Figure 11:
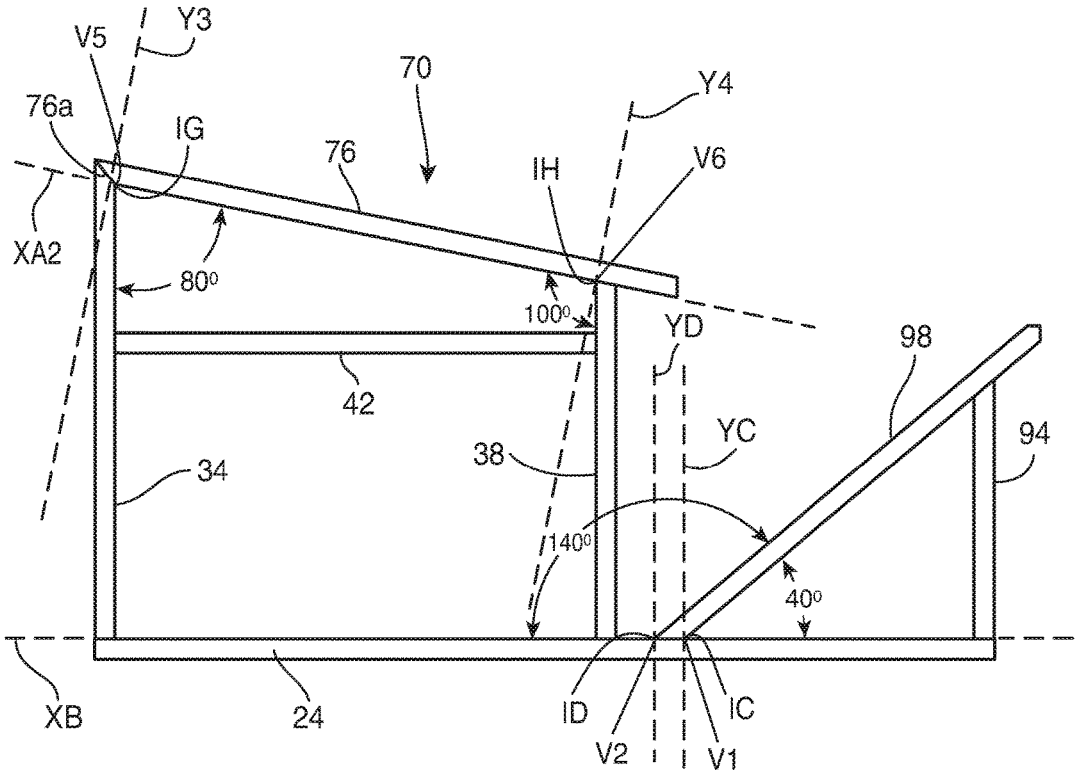
FIG. 11 is a left side elevational view of the front support section and the central support section of the main frame in FIG. 10.
Figure 12:
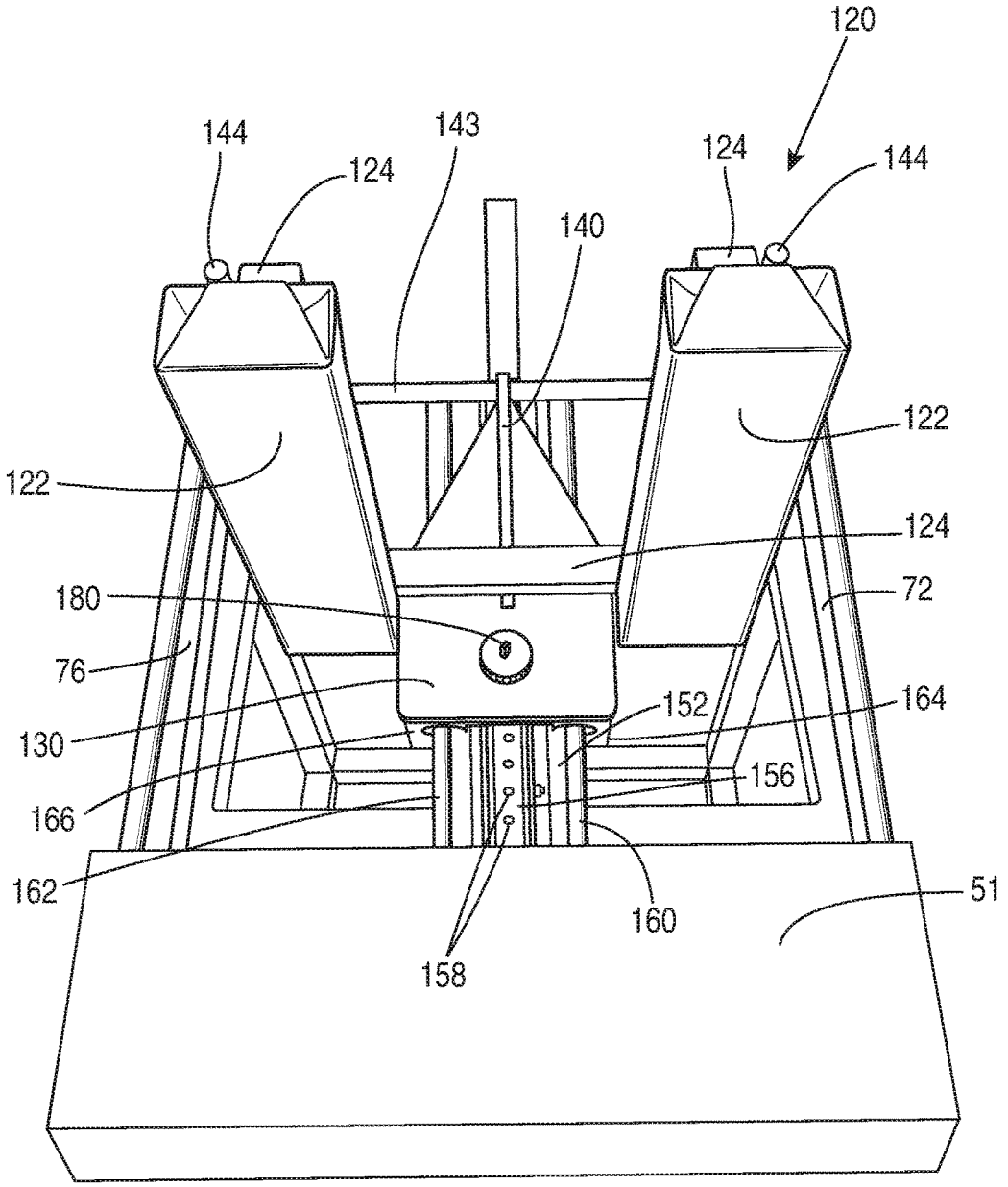
FIG. 12 is a top view of an adjustable shoulder support shown slidably coupled to a track assembly, in accordance to one embodiment of the present invention.
Figure 13:
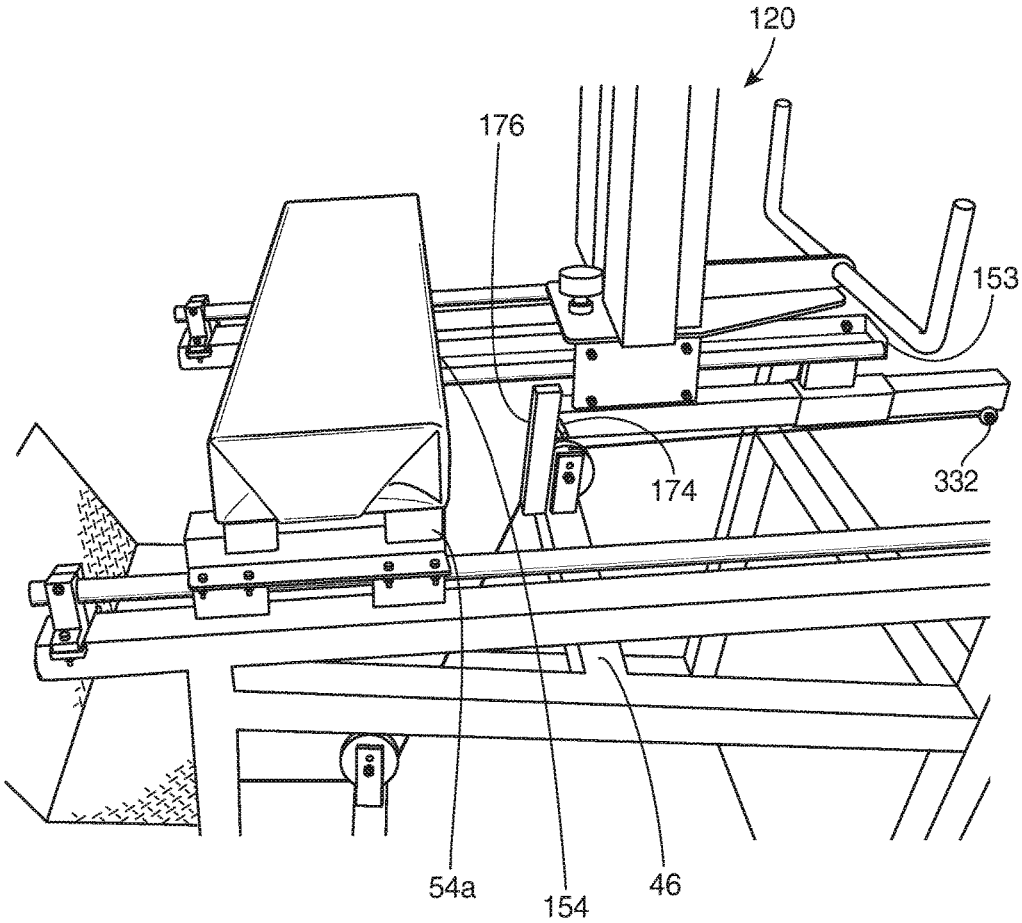
FIG. 13 is a right perspective view of the shoulder support and the upper torso support in FIG. 12.
Figure 14:
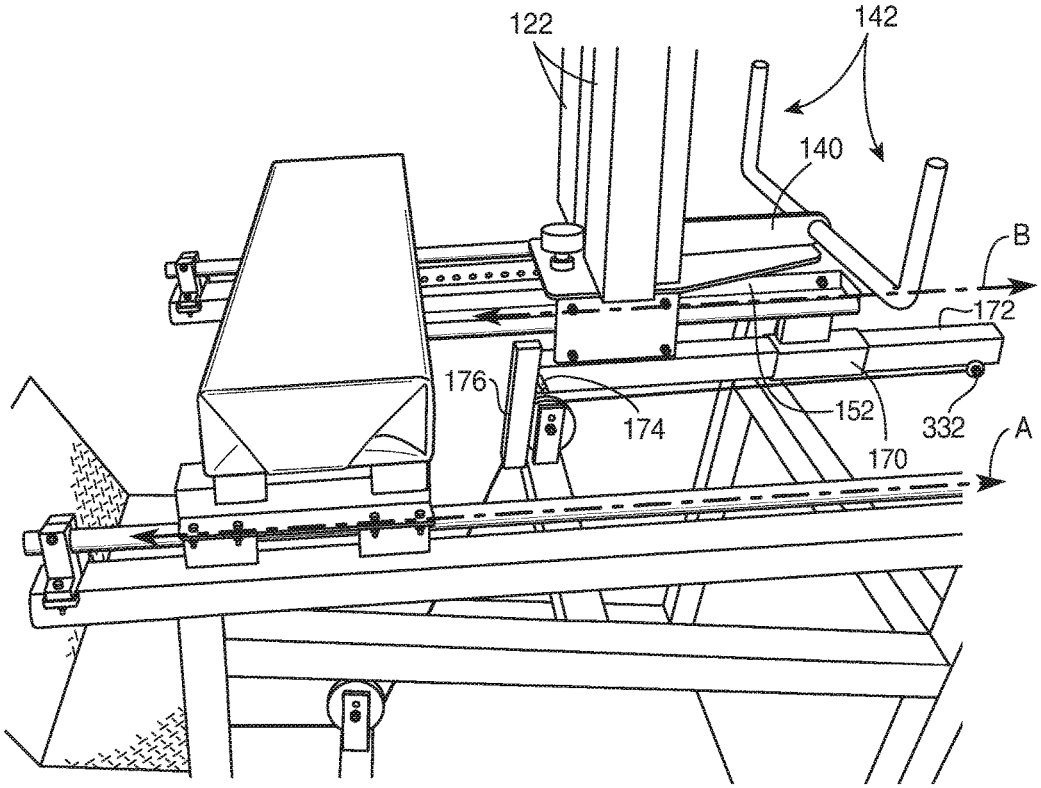
FIG. 14 illustrates the bi-directional path along which the shoulder support moves relative to the bi-directional path along which the upper torso support moves in FIG. 13.
Figure 15:
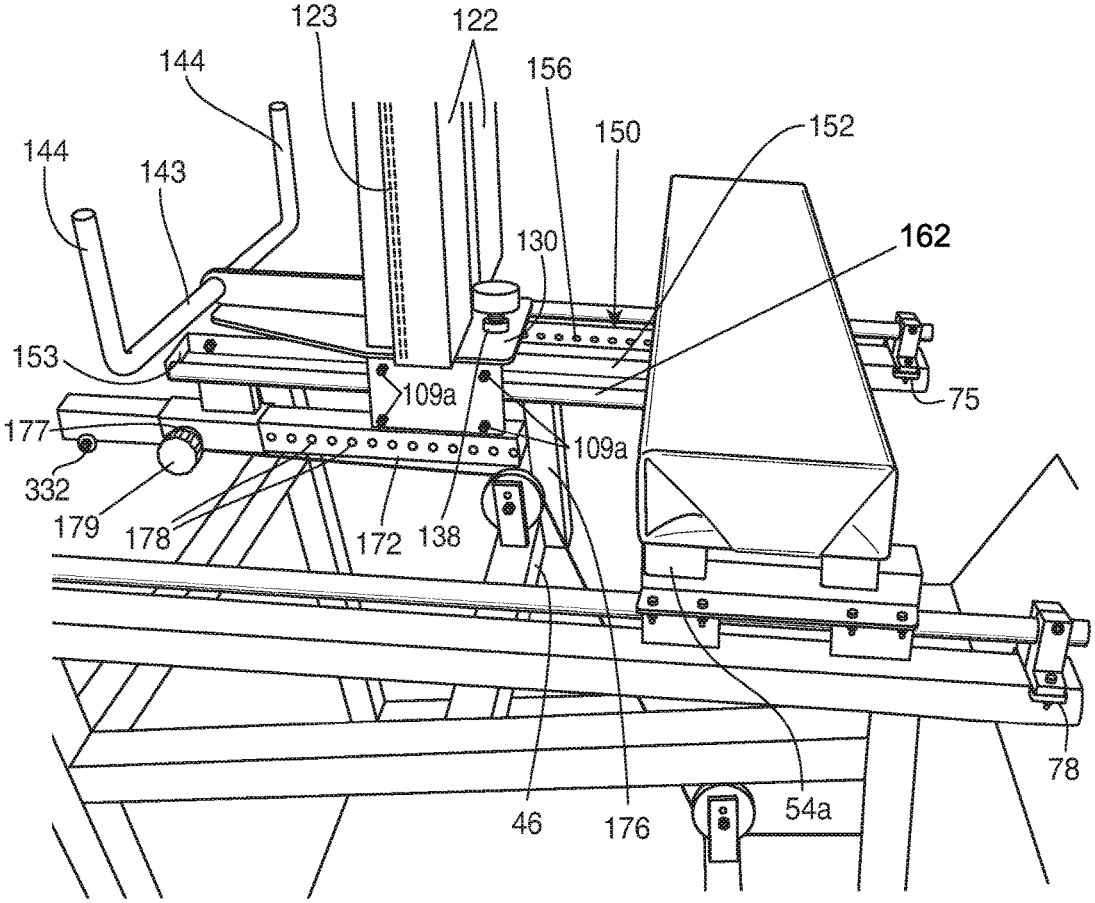
FIG. 15 is a left perspective view of the shoulder support and the upper torso support in FIG. 13.
Figure 17:
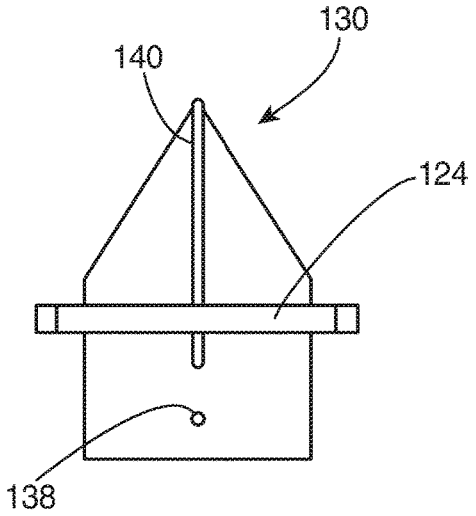
FIG. 17 is a top plan view of the adjustable pads support plate in FIG. 16 illustrating a shoulder support member mounted perpendicularly thereatop.
Figure 16:
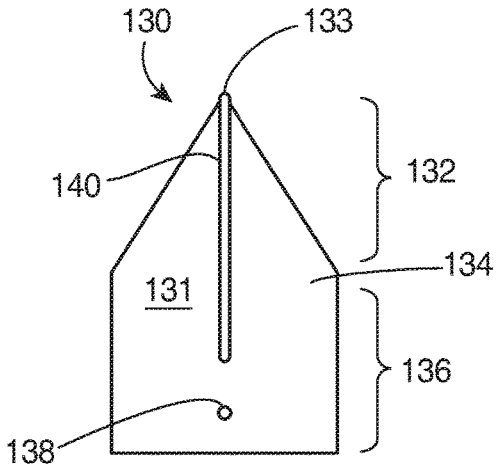
FIG. 16 is a top plan view of an adjustable pads support plate having a hand grips support bracket, in accordance to one embodiment of the present invention.

In reference to FIGS. 10 and 11, the first torso support member 72 further comprises a beveled continuous forward edge 73, and the second torso support member 76 comprises a beveled continuous forward edge 76*a*. The beveled continuous forward edge 73 of first torso support member 72 is securably mounted, such as by arc welding, flush to the beveled continuous upper edge 32*a* of the first vertical member 32. A lower sidewall of first torso support member 72, distal the beveled continuous forward edge 73 thereof, is securably mounted, such as by arc welding, to the beveled continuous upper edge 36*a* of third vertical member 36. The first torso support member 72 joins the first vertical member 32 at interface IE and the third vertical member 36 at interface IF, wherein interface IE forming an angle measuring in a range of approximately 75° to 85°, in a preferred range of approximately 78° to 82°, and most preferably 80°, and wherein interface IF forming an angle measuring in a range of approximately 95° to 105°, in a preferred range of approximately 98° to 102°, and most preferably 100°. The angles formed by interface IE and interface IF are supplementary angles. By way of example, in particular reference to FIG. 10, interface IE is depicted as having a vertex V3. The lower sidewall of first torso support member 72 provides the X-axis XA1 (horizontal). The Y-axis (vertical or perpendicular from horizontal) is depicted by the vertical dotted line referenced as "Y1". The X-axis XA1 and the Y-axis Y1 meet at vertex V3; thus, the angle formed by the joining of first torso support member 72 and the first vertical member 32 at interface IE measures 80°. Further, interface IF is depicted as having a vertex V4. As delineated previously, the X-axis XA1 is provided by the lower sidewall of first torso support member 72. The Y-axis associated with interface IF is depicted by the vertical dotted line referenced as "Y2". The X-axis XA1 and the Y-axis Y2 meet at vertex V4; thus, the angle formed by the joining of first torso support member 72 and the third vertical member 36 at interface IF measures 100°. By way of further example, in particular reference to FIG. 11, the beveled continuous forward edge 76*a* of second torso support member 76 is securably mounted, such as by arc welding, flush to the beveled continuous upper edge 34*a* of the second vertical member 34. A lower sidewall of second torso support member 76, distal the beveled continuous forward edge 76*a* thereof, is securably mounted, such as by arc welding, to the beveled continuous upper edge 38*a* of fourth vertical member 38. The second torso support member 76 joins the second vertical member 34 at interface IG and the fourth vertical member 38 at interface IH, wherein interface IG forming an angle measuring in a range of approximately 75° to 85°, in a preferred range of approximately 78° to 82°, and most preferably 80°, and wherein interface IH forming an angle measuring in a range of approximately 95° to 105°, in a preferred range of approximately 98° to 102°, and most preferably 100°. The angles formed by interface IG and interface IH are supplementary angles. By way of example, in particular reference to FIG. 11, interface IG is depicted as having a vertex V5. The lower sidewall of second torso support member 76 provides the X-axis XA2 (horizontal). The Y-axis (vertical or perpendicular from horizontal) is depicted by the vertical dotted line referenced as "Y3". The X-axis XA2 and the Y-axis Y3 meet at vertex V5; thus, the angle formed by the joining of second torso support member 76 and the second vertical member 34 at interface IG measures 80°. Further, interface IH is depicted as having a vertex V6. As delineated previously, the X-axis XA2 is provided by the lower sidewall of second torso support member 76. The Y-axis associated with interface IH is depicted by the vertical dotted line referenced as "Y4". The X-axis XA2 and the Y-axis Y4 meet at vertex V6; thus, the angle formed by the joining of second torso support member 76 and the fourth vertical member 38 at interface IH measures 100°. Thus, the inclined upper torso support 50 slidably translates bi-directionally along the torso carriage assembly 60 in a linear, inclined path at an angle measuring in a range of approximately 95° to 105°, in a preferred range of approximately 98° to 102°, and most preferably 100°.

Figure 9:
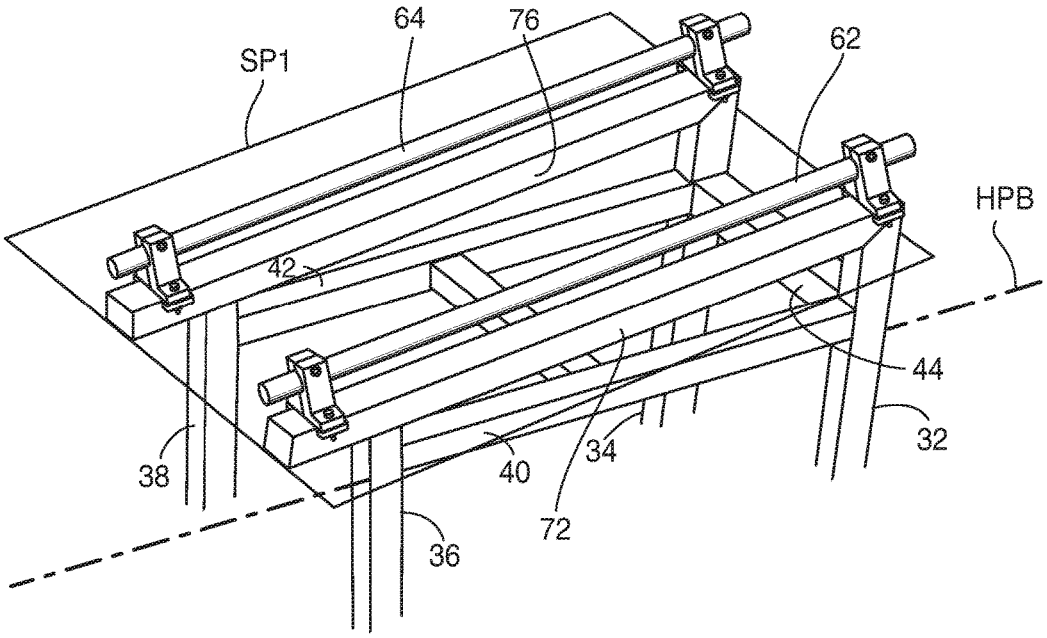
FIG. 9 illustrates the sloped plane about which a first torso support member and a second torso support member of the carriage support base of FIG. 8 lie.

As depicted in FIG. 9, the first torso support member 72 and second torso support member 76 are coplanar and lie in a sloped plane SP1 relative to horizontal plane HPB about which the first brace member 40, the second brace member 42, the first upper crossmember 44, and the second upper crossmember 46 lie.

Referring now to FIGS. 3, and 5-9, the torso carriage assembly 60 comprises a first guide rod 62 and a second guide rod 64, wherein first guide rod 62 is mounted superjacent the first elongated torso support member 72 via a first pair of T-shaped guide rod support brackets 66 and 67 and the second guide rod 64 is mounted superjacent the second elongated torso support member 76 via a second pair of T-shaped guide rod support brackets 68 and 69. The first pair of T-shaped guide rod support brackets 66 and 67 is mechanically coupled, respectively, to the first and second pair of flanges 74 and 75 of the first torso support member 72 via mechanical fasteners 109*a*, such as nuts and bolts. The second pair of T-shaped guide rod support brackets 68 and 69 is mechanically coupled, respectively, to the first and second pair of flanges 77 and 78 of the second torso support member 76 via mechanical fasteners 109*a*, such as nuts and bolts. The torso carriage assembly 60 further comprises a carriage 61 enabling slidable translation of the upper torso support 50, and more particularly cushioned pad 51, along the first and second guide rods 62 and 64. The carriage 61 includes first and second truck support structures 100 and 105 to each of which a plurality of trucks 110 is mounted. The first and second truck support structures 100 and 105 each respectively has a T-shaped cross-sectional configuration comprising an elongated tubular body 102, 107 and a planar bottom 103, 108 securably mounted, such as by arc welding, to an underside of the elongated tubular body 102, 107. The planar bottom 103, 108 has a greater transverse width than a width of the elongated tubular body 102, 107, thus each planar bottom 103, 108 provides a truck mounting ledge 104, 108*a*, respectively, to which the plurality of trucks 110 is mechanically coupled via mechanical fasteners 109, such as nuts and bolts. A first truck 111 and a second truck 112 are mechanically coupled spatially to an underside of truck mounting ledge 104. A third truck 113 and a fourth truck 114 are mechanically coupled spatially to an underside of truck mounting ledge 108*a*. The first truck 111 and the second truck 112 are slidably coupled to the first guide rod 62. The third truck 113 and the fourth truck 114 are slidably coupled to the second guide rod 64. The first truck 111 and the second truck 112 slidably engage and cooperate with the first guide rod 62. The third truck 113 and the fourth truck 114 slidably engage and cooperate with the second guide rod 64. The trucks 110 (trucks 111, 112, 113, and 114) are each disposed with bearings 115 which cooperate, respectively, with first and second guide rods 62 and 64, thereby enabling the trucks 110, and thus the upper torso support 50, to slidably translate smoothly along the first and second guide rods 62 and 64. The trucks 110 are configured to facilitate substantially frictionless motion by the upper torso support 50 along the first and second guide rods 62 and 64. The upper torso support 50 slidably translates along the first and second guide rods 62 and 64 in a linear, sloped path indicated by bi-directional line A shown in FIG. 3. Accordingly, the upper torso support 50 slidably translates along a plane parallel to and above sloped plane SP1 (FIG. 9) along which the first torso support member 72 and second torso support member 76 lie.

Referring now more particularly to FIGS. 12-15, an adjustable shoulder support 120 slidably coupled to a track assembly 150 is disclosed. The track assembly 150 is adapted and configured to enable slidable translation of the shoulder support 120 along a pair of rails 160 and 162. The track assembly 150 comprises an elongated track 156 mounted atop a track support plate 152. The track support plate 152 includes a forward end 153 and a rearward end 154, the rearward end 154 is securably mounted, such as by arc welding, to a forward sidewall of forward pad support member 54*a*. A tubular shaft 172 is mechanically coupled subjacent the track support plate 152 via an L-shaped shaft receiver 170. The shaft receiver 170 is securably mounted, such as by arc welding, to the lower surface of track support plate 152, proximate the forward end 153 thereof. The tubular shaft 172 slidably engages the shaft receiver 170 in a telescopic manner. A threaded aperture 177 for threaded engagement by a pin 179 is provided in the inner sidewall of shaft receiver 170. The threaded aperture 177 aligns and cooperates with a series of longitudinally-oriented holes 178 provided in the tubular shaft 172 to enable the pin 179 to secure the shaft receiver 170 at a selectively-desired, longitudinal setting position. The tubular shaft 172 includes an outwardly-projecting abutment post 174 securably mounted, such as by arc welding, to an outer sidewall of tubular shaft 172, proximate a rearward end thereof. The abutment post 174 engages the stop member 176 on the second upper crossmember 46, thereby supporting the shoulder support 120 and the upper torso support 50 in the exercise start position of the machine 10 illustrated in FIGS. 1 and 13.

The track support plate 152 is flanked by a first rail 160 and a second rail 162 along which the shoulder support 120 slidably translates. The first rail 160 is mounted to a side edge of track support plate 152, and the second rail 162 is mounted to the opposing side edge of plate 152. The first and second guide rails 160 and 162 to be described later in greater detail.

Referring now to FIGS. 12-18, and more specifically, FIGS. 12, 14, and 16-18, the shoulder support 120 comprises cushioned shoulder pads 122 mounted perpendicularly atop an adjustable pads support plate 130. The cushioned shoulder pads 122 overlie respective pad platforms 123 which are mounted to a U-shaped shoulder support member 124. The shoulder support member 124 is securably mounted, such as by arc welding, perpendicularly atop the pads support plate 130. The pads support plate 130 comprises an upper region 132, a lower region 136, and an intermediate section 134 integrally interfacing the upper and lower regions 132 and 136. The lower region 136 generally comprises a square-shaped configuration, and the upper region 132 generally comprises a conical-shaped configuration. More specifically, the lower region 136 generally comprises a square-shaped configuration tapering inward from a greater transverse width at intermediate section 134 to a smaller transverse width in the upper region 132 and terminating to a substantially smaller transverse width forming an apex 133. A threaded aperture 138 for threaded engagement by a pin 180 is provided in the lower region 136 of pads support plate 130. The threaded aperture 138 aligns and cooperates with a series of longitudinally-oriented holes 158 provided in the elongated track 156 to enable the pin 180 to secure the pads support plate 130 at a selectively-desired, longitudinal setting position.

An upwardly projecting hand grips support bracket 140 is securably mounted, such as by arc welding, longitudinally to an upper surface 131 of the pads support plate 130. Grip members 142 are securably mounted, such as by arc welding, transverse to hand grips support bracket 140. The grip members 142 comprise an elongated transverse section 143 having opposed ends from which respective hand grips 144 integrally extend orthogonally therefrom and oriented substantially perpendicular to the track support plate 152.

Figure 18:
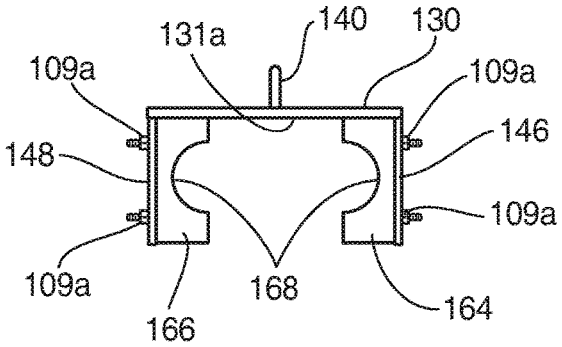
FIG. 18 is a rear end view of an adjustable pads support plate illustrating a pair of truck mounting plates downwardly depending respectively from opposing edges of the adjustable pads support plate, in accordance to one embodiment of the present invention.
Figure 19:
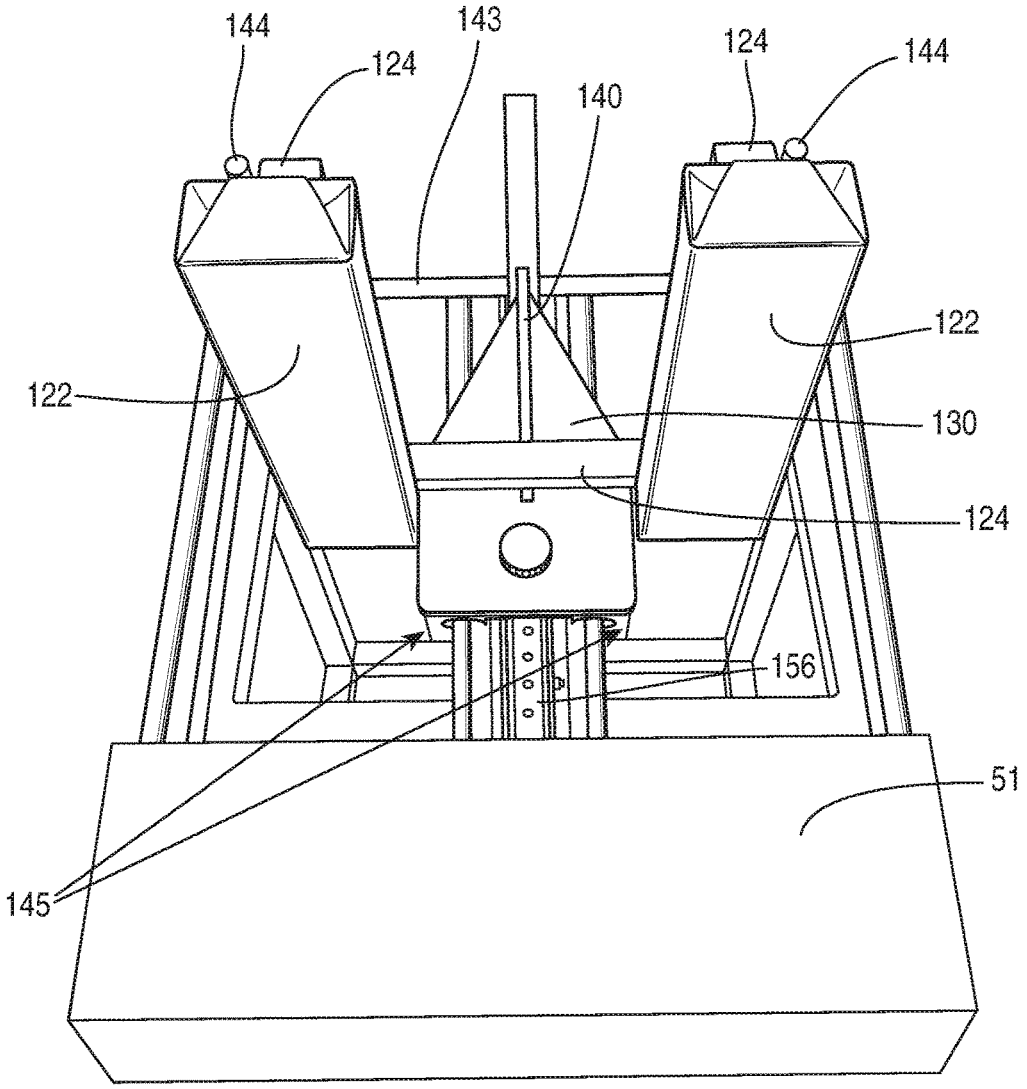
FIG. 19 is a top perspective view depicting shoulder pads mounted perpendicularly atop the adjustable pads support plate, in accordance with one embodiment of the present invention.
Figure 20:
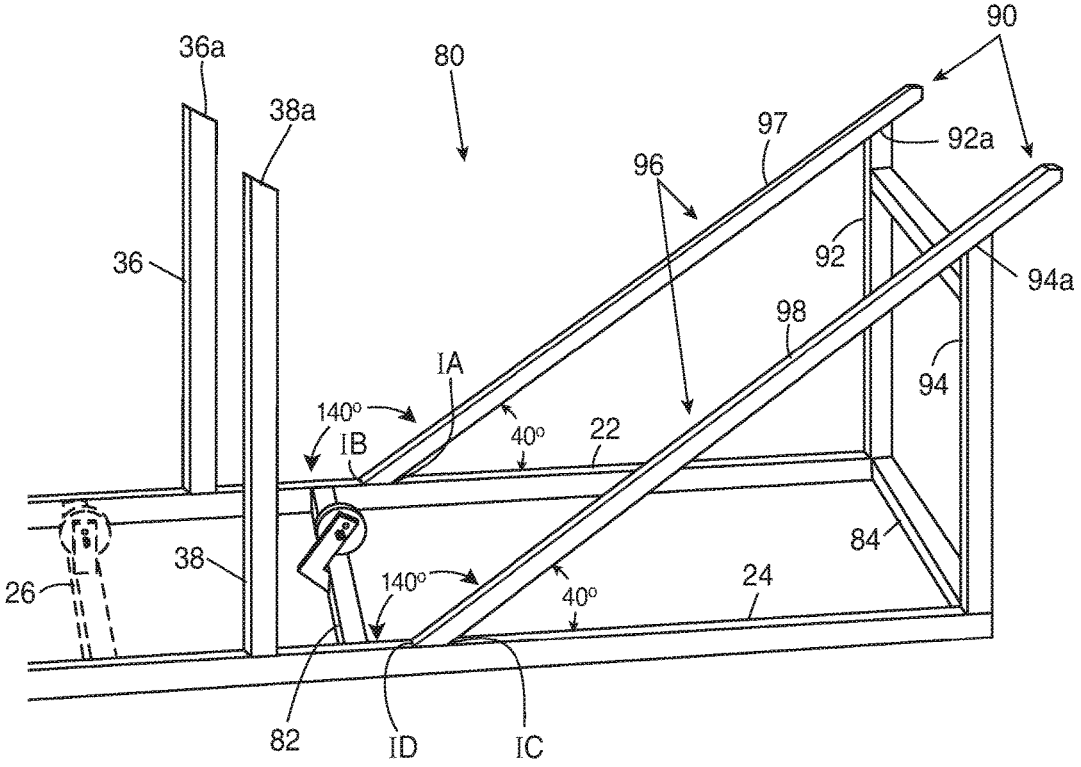
FIG. 20 is a left side perspective view of the central support section illustrating a plurality of tubular upright members and tubular sloped members, in accordance to one embodiment of the present invention.
Figure 21:
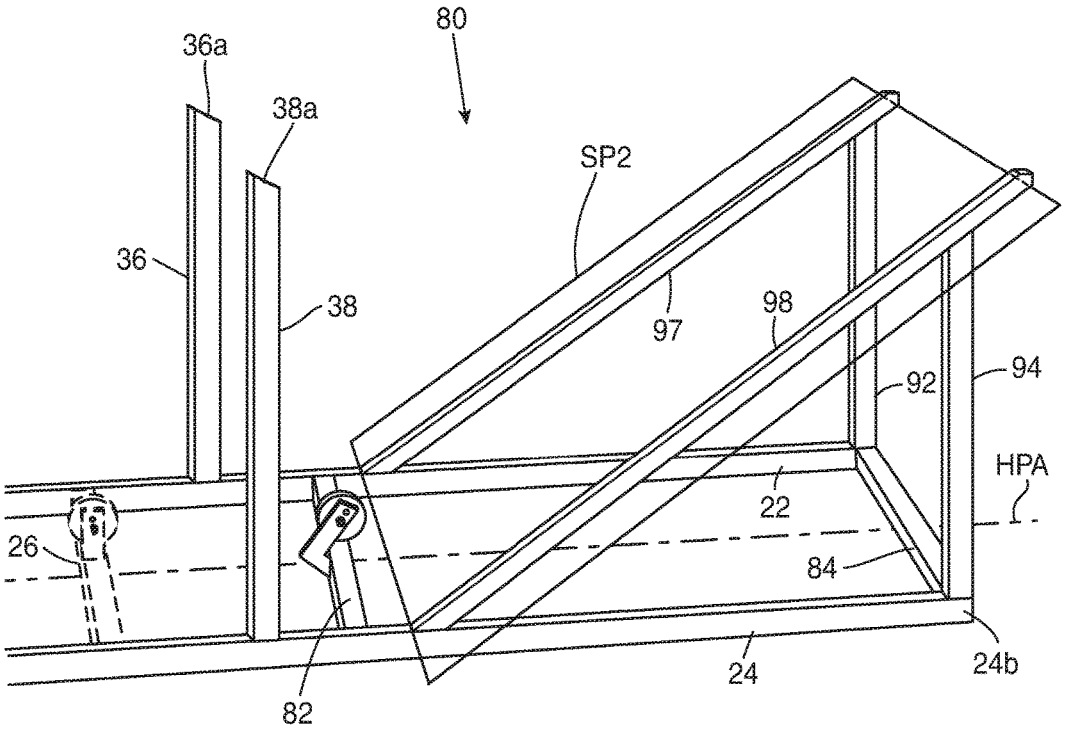
FIG. 21 is a left side perspective view of the central support section in FIG. 20 illustrating the sloped plane along which the first sloped member and the second sloped member lie.

Referring now more particularly to FIGS. 18 and 19, a pair of truck mounting plates 145 downwardly depends respectively from opposing edges of a lower surface 131*a* of the pads support plate 130. The pair of truck mounting plates 145 comprises a first truck mounting plate 146 and a second truck mounting plate 148. The truck mounting plates 146 and 148 are securably mounted, such as by arc welding, to the lower surface 131*a* edges of pads support plate 130. A first shoulder support truck 164 is mounted to an inner sidewall of the first truck mounting plate 146 via mechanical fasteners 109*a*, such as nuts and bolts. A second shoulder support truck 166 is mounted to an inner sidewall of the second truck mounting plate 148 via mechanical fasteners 109*a*, such as nuts and bolts. The first shoulder support truck 164 is slidably coupled to the first guide rail 160, and the second shoulder support truck 166 is slidably coupled to the second guide rail 162. The first shoulder support truck 164 and the second shoulder support truck 166 are each disposed with bearings 168 which slidably engage and cooperate, respectively, with the first and second guide rails 160 and 162, thereby enabling the trucks 164 and 166, and thus the shoulder support 120, to slidably translate smoothly along the first and second guide rails 160 and 162. The first and second trucks 164 and 166 are configured to facilitate substantially frictionless motion by the shoulder support 120 along the first and second guide rails 160 and 162. The following described movement and plane about which shoulder support 120 moves relative to the plane about which the upper torso support 50 translates is critical to the present invention for allowing the user to obtain comprehensive health and fitness when using the strength and fitness exercise machine 10 during an exercise session. The shoulder support 120 moves bi-directionally in a linear, sloped path indicated by bi-directional line B shown in FIG. 14. The shoulder support 120 moves bi-directionally along a plane parallel to and above the plane about which the upper torso support 50 slidably translates, and accordingly, the shoulder support 120 slidably translates along a plane parallel to and above sloped plane SP1 along which the first torso support member 72 and second torso support member 76 lie.

To accommodate users of varied upper and lower torso lengths, the cushioned shoulder pads 122 and hand grips 144 are longitudinally-adjustable, thereby enabling a plurality of selectively-desired, longitudinal setting positions of the shoulder support 120. The track 156 is provided with a series of longitudinally-oriented holes 158. For purposes of this disclosure, the series of longitudinally-oriented holes 158 are defined as "blind holes". Blind holes are intended to mean and are defined herein as openings which do not extend completely through the track support plate 152. Thus, in accordance to the embodiment wherein the series of longitudinally-oriented holes 158 is provided in the track 156, a top of each of the holes 158 is oriented along an upper surface of the track 156, and the holes 158 extend downward a depth short of the bottom of track support plate 152. The tubular shaft 172 is also provided with a series of longitudinally-oriented holes 178 defined through the inner sidewall thereof. When performing an exercise using the machine 10, the shoulder pads 122 and hand grips 144 move concurrently or otherwise in a conjunctive manner. Thus, to adjust the shoulder pads 122, and consequently, the hand grips 144 to a selectively-desired, longitudinal setting position, pin 179 is threadedly disengaged and removed from the present hole 178 setting and the threaded aperture 177 of shaft receiver 170, and pin 180 is threadedly disengaged and removed from the present hole 158 setting and the threaded aperture 138 of pads support plate 130. The shoulder pads 122 are slidably moved longitudinally along the first and second guide rails 160 and 162 until reaching user's desired setting. While maintaining shoulder pads 122 substantially stationary in user's desired setting, the threaded aperture 138 of pads support plate 130 is aligned with one of the series of holes 158 provided in the track 156. The pin 180 threadedly engages the threaded aperture 138 until pin 180 engages the selected hole 158, thereby securing the shoulder pads 122 to the track 156 of track support plate 152 in accordance with user's selectively-desired, longitudinal setting position. Because the shoulder pads 122 and hand grips 144 move conjunctively, as the shoulder pads 122 are slidably moved, the shaft receiver 170 slidably moves along the tubular shaft 172 in a corresponding manner, thereby also positioning the shaft receiver 170 in user's desired setting, and thus aligning the threaded aperture 177 of shaft receiver 170 with one of the series of holes 178 of tubular shaft 172. Finally, pin 179 threadedly engages the threaded aperture 177 of shaft receiver 170 until pin 179 engages the selected hole 158, thereby securing the shaft receiver 170 to tubular shaft 172 in accordance with user's selectively-desired, longitudinal setting position.

It is envisioned that other locking mechanisms may be utilized for securing both the shoulder pads 122 and hand grips 144 at various longitudinal setting positions. Such locking mechanisms are therefore within the scope and spirit of the present application. In accordance to one locking assembly embodiment, the locking assembly may comprise a spring-biased pin or pin assembly. In lieu of threaded apertures 138 and 177, the pads support plate 130 and the shaft receiver 170 both may include openings, respectively, defined axially therethrough. A first spring-biased pin is disposed about the opening of pads support plate 130 and a second spring-biased pin is disposed about the opening of shaft receiver 170. The track 156 includes the series of longitudinally-oriented holes 158, and the tubular shaft 172 includes the series of longitudinally-oriented holes 178.

In reference to the first pin utilized for securing the shoulder pads 122 to a desired hole 158 setting along the track 156, in a resting position, the first pin is urged by a spring axially towards the track 156. Keeping in mind the shoulder pads 122 and hand grips 144 move in a conjunctive fashion, the second pin is retracted or pulled axially until the second pin is effectively removed from the current hole 178 position and held in such retracted position while the first pin is then retracted or pulled axially until first pin is effectively removed from the current hole 158 position in track 156, and first pin is held in such retracted position, while the shoulder pads 122 are slidably moved longitudinally along the first and second guide rails 160 and 162 (user may now release the second pin) until reaching user's desired setting. While maintaining shoulder pads 122 substantially stationary in user's desired setting, the first pin is released and urged via a spring to engage one of the holes 158 of the track 156.

Similarly, in reference to the second pin utilized for securing the shaft receiver 170 to a desired hole 178 setting of the tubular shaft 172, the second pin is urged by a spring axially towards the tubular shaft 172. As previously described, because the shoulder pads 122 and hand grips 144 move conjunctively, as the shoulder pads 122 are slidably moved, the shaft receiver 170 slidably moves along the tubular shaft 172 in a corresponding manner, thereby also positioning the shaft receiver 170 in user's desired setting, and thus aligning the second pin with one of the series of holes 178 of tubular shaft 172, whereupon the second pin is urged via a spring to automatically engage the hole 178 in current alignment with second pin.

Referring now more particularly to FIGS. 1, 10, 11, and 20-22, the central support section 80 further comprises a forward crossmember 82 and a rearward crossmember 84. The forward crossmember 82 is securably mounted, such as by arc welding, between respective inner sidewalls of the first horizontal member 22 and second horizontal member 24, proximate the second lower crossmember 26 and rearward to the third and fourth vertical members 36, 38 of front support section 20. The rearward crossmember 84 is securably mounted, such as by arc welding, between respective inner sidewalls of the first horizontal member 22 and second horizontal member 24 at rear ends 22*b* and 24*b*, respectively, thereof. The first horizontal member 22, second horizontal member 24, first lower tubular crossmember 25, second lower tubular crossmember 26, forward crossmember 82, and rearward crossmember 84 are coplanar and lie in horizontal plane HPA, wherein horizontal plane HPA is parallel to the floor F or other flat surface upon which the machine 10 is supported.

The central support section 80 further comprises a plurality of tubular upright members 90 and a plurality of tubular sloped members 96. The plurality of tubular upright members 90 comprises a first upright member 92 and a second upright member 94. The first upright member 92 is securably mounted, such as by arc welding, perpendicularly to an upper sidewall of the first horizontal member 22 at the rear end 22*b* thereof. The second upright member 94 is securably mounted, such as by arc welding, perpendicularly to an upper sidewall of the second horizontal member 24 at the rear end 24*b* thereof. The first upright member 92 and second upright member 94 are of equal height. Both the first and second upright members 92 and 94 each comprises a beveled continuous upper edge 92*a* and 94*a*, respectively.

An upper crossmember 86 is securably mounted, such as by arc welding, between respective inner sidewalls of the first upright member 92 and the second upright member 94, distally above the rearward crossmember 84, and proximate the beveled continuous upper edge 92*a*, 94*a* of first upright member 92 and second upright member 94, respectively.

The plurality of tubular sloped members 96 comprises a first sloped member 97 and a second sloped member 98. A lower end of the first sloped member 97 is securably mounted, such as by arc welding, to the upper sidewall of first horizontal member 22, proximally rearward the forward crossmember 82. A lower sidewall of first sloped member 97, distal the lower end thereof, is securably mounted, such as by arc welding, to the beveled continuous upper edge 92*a* of the first upright member 92. The first sloped member 97 joins the first horizontal member 22 at interface IA and at interface IB, wherein interface IA forming an angle measuring in a range of approximately 20° to 60°, in a preferred range of approximately 30° to 50°, and most preferably 40°, and wherein interface IB forming an angle measuring in a range of approximately 120° to 160°, in a preferred range of approximately 130° to 150°, and most preferably 140°. The angles formed by interface IA and interface IB are supplementary angles. By way of example, in particular reference to FIG. 10, interface IA is depicted as having a vertex V. The upper sidewall of first horizontal member 22 provides the X-axis XA (horizontal). The Y-axis (vertical or perpendicular from horizontal) is depicted by the vertical dotted line referenced as "YA". The X-axis XA and the Y-axis YA meet at vertex V; thus, the angle formed by the joining of first sloped member 97 and the first horizontal member 22 at interface IA measures 40°. Further, interface IB is depicted as having a vertex V'. As delineated previously, the X-axis XA is provided by the upper sidewall of first horizontal member 22. The Y-axis associated with interface IB is depicted by the vertical dotted line referenced as "YB". The X-axis XA and the Y-axis YB meet at vertex V'; thus, the angle formed by the joining of first sloped member 97 and the first horizontal member 22 at interface IB measures 140°. By way of further example, a lower end of the second sloped member 98 is securably mounted, such as by arc welding, to the upper sidewall of second horizontal member 24, proximally rearward the forward crossmember 82. A lower sidewall of second sloped member 98, distal the lower end thereof, is securably mounted, such as by arc welding, to the beveled continuous upper edge 94*a* of the second upright member 94. The second sloped member 98 joins the second horizontal member 24 at interface IC and at interface ID, wherein interface IC forming an angle measuring in a range of approximately 20° to 60°, in a preferred range of approximately 30° to 50°, and most preferably 40°, and wherein interface ID forming an angle measuring in a range of approximately 120° to 160°, in a preferred range of approximately 130° to 150°, and most preferably 140°. The angles formed by interface IC and interface ID are supplementary angles. By way of example, in particular reference to FIG. 11, interface IC is depicted as having a vertex V1. The upper sidewall of second horizontal member 24 provides the X-axis XB (horizontal). The Y-axis (vertical or perpendicular from horizontal) is depicted by the vertical dotted line referenced as "YC". The X-axis XB and the Y-axis YC meet at vertex V1; thus, the angle formed by the joining of second sloped member 98 and the second horizontal member 24 at interface IC measures 40°. Further, interface ID is depicted as having a vertex V2. As delineated previously, the X-axis XB is provided by the upper sidewall of second horizontal member 24. The Y-axis associated with interface ID is depicted by the vertical dotted line referenced as "YD". The X-axis XB and the Y-axis YD meet at vertex V2; thus, the angle formed by the joining of second sloped member 98 and the second horizontal member 24 at interface ID measures 140°. The first sloped member 97 and the second sloped member 98 are coplanar and lie in a sloped plane SP2 relative to the horizontal plane HPA along which first horizontal member 22, second horizontal member 24, first lower tubular crossmember 25, second lower tubular crossmember 26, forward crossmember 82, and rearward crossmember 84 lie.

Figure 22:
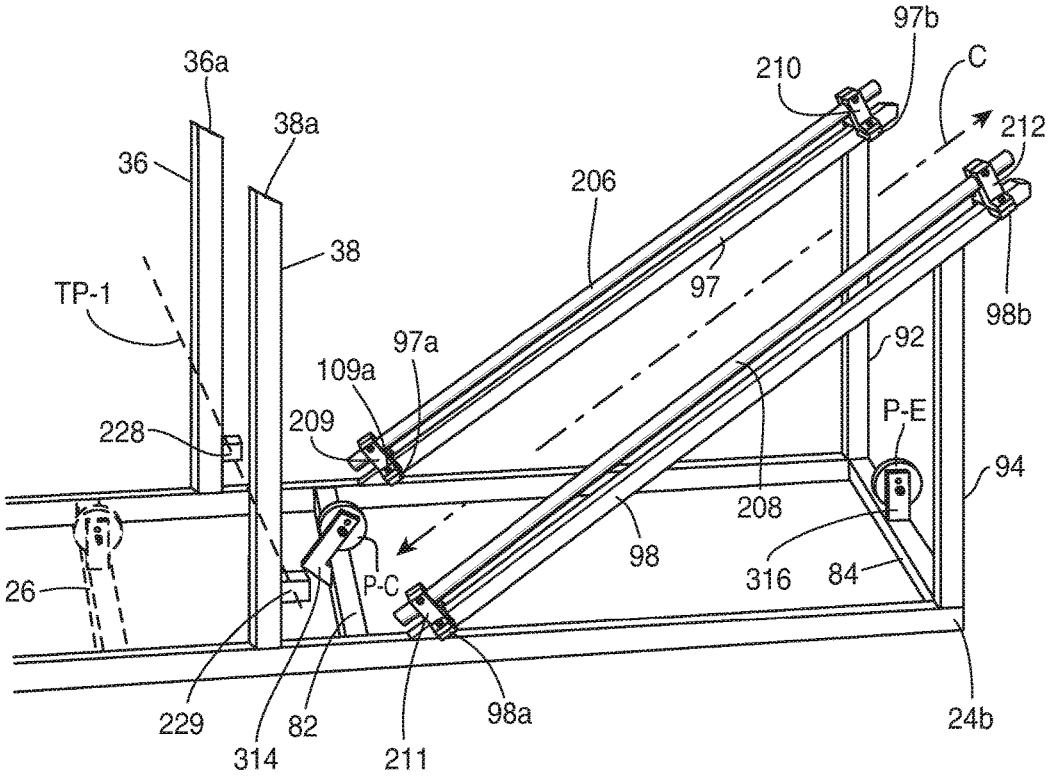
FIG. 22 is a left side perspective view of the central support section illustrating the bi-directional, declined path along which a foot platform slidably translates, in accordance with one embodiment of the present invention.
Figure 23:
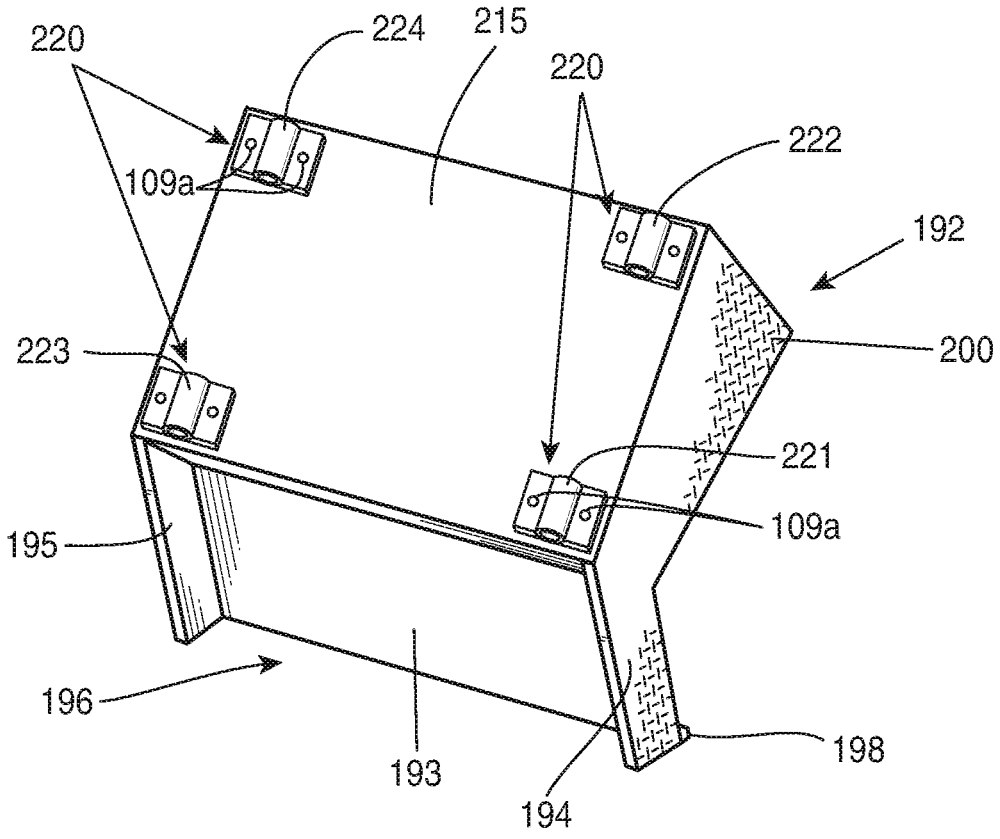
FIG. 23 is a bottom perspective view of foot platform, in accordance with one embodiment of the present invention.
Figure 24:
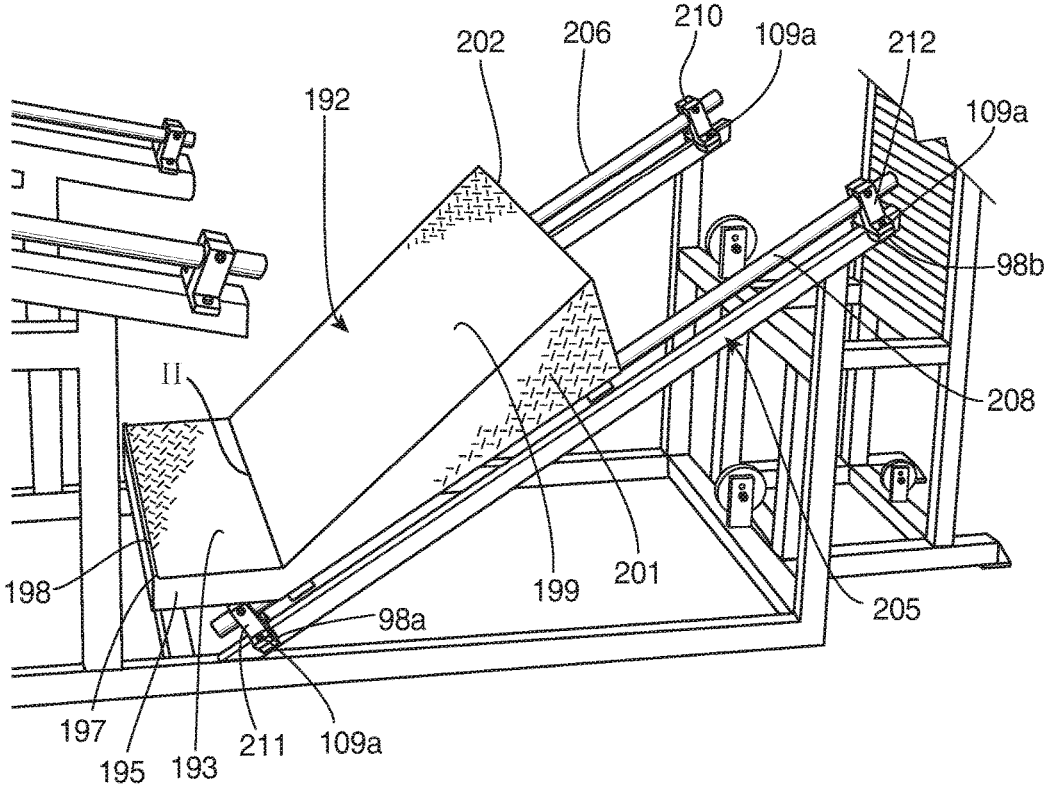
FIG. 24 is a partial left side perspective view of the central support section and the rear support section of the main frame illustrating a foot platform mechanically coupled superjacent a foot support carriage, in accordance to one embodiment of the present invention.

Referring now more particularly to FIG. 22, the first sloped member 97 further comprises a first and second pair of flanges 97*a* and 97*b* which provide mounting platforms for platform rod support brackets 209 and 210 (to be described later in greater detail). The second sloped member 98 further comprises a first and second pair of flanges 98*a* and 98*b* which provide mounting platforms for platform rod support brackets 211 and 212 (to be described later in greater detail). In reference to the flanges 97*a* and 97*b* of first sloped member 97, the first pair of flanges 97*a* flanks the lateral sidewalls of the first sloped member 97 proximate a forward end thereof. The first pair of flanges 97*a* projects outwardly in an integral fashion from the lateral sidewalls of first sloped member 97. The first pair of flanges 97*a* has upper surfaces which are coplanar with the upper sidewall of the first sloped member 97. The second pair of flanges 97*b* flanks the lateral sidewalls of the first sloped member 97 proximate a rearward end thereof. The second pair of flanges 97*b* projects outwardly in an integral fashion from the lateral sidewalls of first sloped member 97. The second pair of flanges 97*b* has upper surfaces which are coplanar with the upper sidewall of the first sloped member 97.

In reference to the flanges 98*a* and 98*b* of second sloped member 98, the first pair of flanges 98*a* flanks the lateral sidewalls of the second sloped member 98 proximate a forward end thereof. The first pair of flanges 98*a* projects outwardly in an integral fashion from the lateral sidewalls of second sloped member 98. The first pair of flanges 98*a* has upper surfaces which are coplanar with the upper sidewall of the second sloped member 98. The second pair of flanges 98*b* flanks the lateral sidewalls of the second sloped member 98 proximate a rearward end thereof. The second pair of flanges 98*b* projects outwardly in an integral fashion from the lateral sidewalls of second sloped member 98. The second pair of flanges 98*b* has upper surfaces which are coplanar with the upper sidewall of the second sloped member 98.

Referring now to FIGS. 1, and 22-25, the central support section 80 includes a foot support assembly 190 comprising a foot platform 192 mechanically coupled superjacent a foot support carriage 205 enabling the foot platform 192 to slidably translate bi-directionally in a linear, declined path indicated by bi-directional line C (shown in FIG. 22). The foot platform 192 is constructed of a strong, rigid, and durable material such as steel. In accordance to one embodiment, the foot platform 192 may be constructed of diamond plated metal, as depicted in the figures. The foot platform 192 comprises a horizontal forward section 193 having opposing downwardly depending sidewalls 194 and 195, an open front end 196, and a forward edge 197 from which a raised lip 198 extends integrally a length there down. An upper surface of the horizontal forward section 193 is oriented coplanar to horizontal plane HPA.

Figure 25:
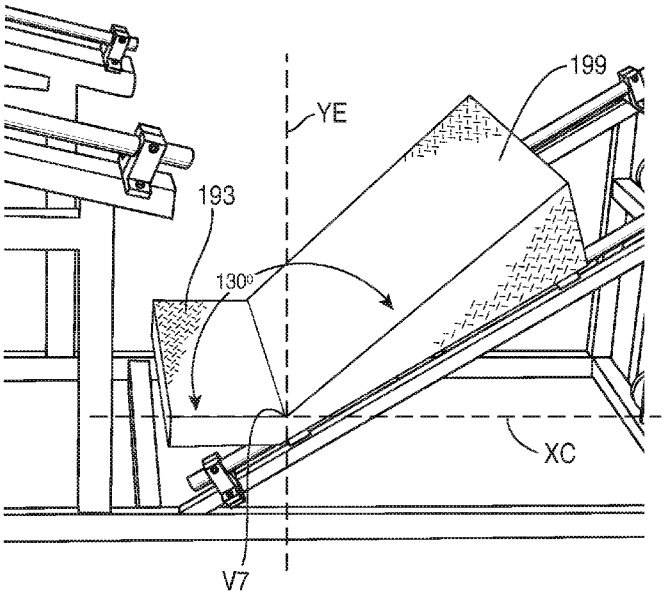
FIG. 25 depicts the angular position of the foot engaging section relative to the horizontal forward section of a foot platform, in accordance to one embodiment of the present invention.
Figure 26:
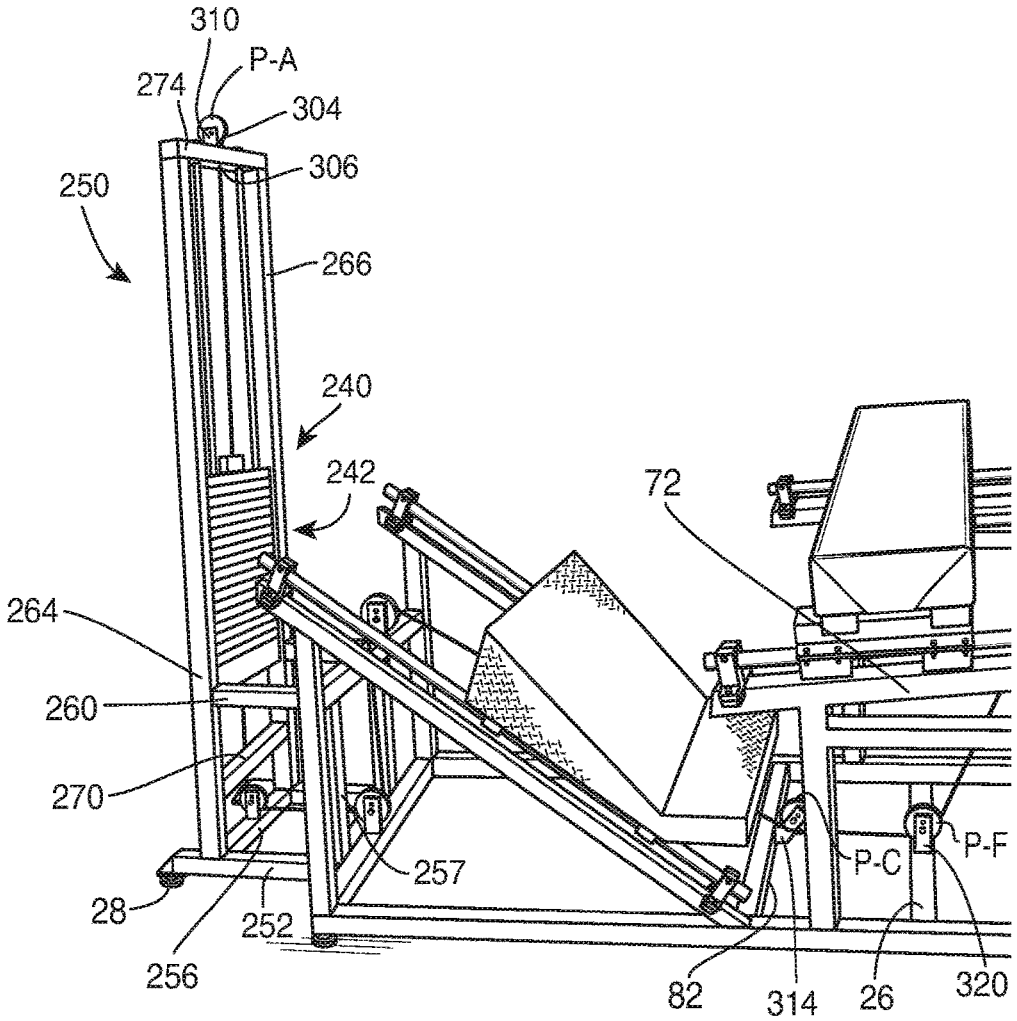
FIG. 26 is a partial right side perspective view of the central support section and the rear support section of the main frame illustrating an adjustable resistance, in accordance to one embodiment of the present invention.

The foot platform 192 further comprises a foot engaging section 199 having opposing downwardly depending, conical-shaped sidewalls 200 and 201, and a rear sidewall 202. The foot engaging section 199 extends integrally from the horizontal forward section 193 at interface II, wherein interface II forming an angle measuring in a range of approximately 125° to 135°, in a preferred range of approximately 127.5° to 132.5°, and most preferably 130°. Interface II is depicted as having a vertex V7. The upper surface of the horizontal forward section 193 provides the X-axis XC (horizontal). The Y-axis (vertical or perpendicular from horizontal) is depicted by the vertical dotted line referenced as "YE". The X-axis XC and the Y-axis YE meet at vertex V7; thus, the angle formed by the joining of the upper surface of horizontal forward section 193 and the upper surface of foot engaging section 199 at interface II preferably measures 130°, as illustrated in FIG. 25. Thus, the foot engaging section 199 of the foot platform 192 slidably translates bi-directionally along the foot support carriage 205 in a linear, declined path at an angle measuring in a range of approximately 115° to 145°, in a preferred range of approximately 122.5° to 137.5°, and most preferably 130°.

The measure of the angle of the foot engaging section 199 (at interface II as described and illustrated herein) is critical to the present invention in relation to the orientation of the upper torso support 50 and shoulder support 120, as previously described, for allowing the user of the machine 10 to both achieve comprehensive health and fitness and substantially reduce the risk of injury to the knee joints and lumbar spine.

The foot support carriage 205 comprises a first platform guide rod 206 and a second platform guide rod 208. The first platform guide rod 206 is mounted superjacent the first sloped member 97 via a first pair of platform rod support brackets 209 and 210 and the second platform guide rod 208 is mounted superjacent the second sloped member 98 via a second pair of platform rod support brackets 211 and 212. The first pair of platform rod support brackets 209 and 210 is mechanically coupled, respectively, to the first and second pair of flanges 97*a* and 97*b* of the first sloped member 97 via mechanical fasteners 109*a*, such as nuts and bolts. The second pair of platform rod support brackets 211 and 212 is mechanically coupled, respectively, to the first and second pair of flanges 98*a* and 98*b* of the second sloped member 98 via mechanical fasteners 109*a*, such as nuts and bolts.

The foot support carriage 205 further comprises a truck support plate 215 to which a plurality of platform trucks 220 are mechanically coupled via mechanical fasteners 109*a*, such as nuts and bolts. A first platform truck 221, a second platform truck 222, a third platform truck 223, and a fourth platform truck 224 are mounted about respective corners along an underside of truck support plate 215 via mechanical fasteners 109*a*, such as nuts and bolts. The first platform truck 221 and the second platform truck 222 are slidably coupled to the first platform guide rod 206. The third platform truck 223 and the fourth platform truck 224 are slidably coupled to the second platform guide rod 208. The first platform truck 221 and the second platform truck 222 slidably engage and cooperate with the first platform guide rod 206. The third platform truck 223 and the fourth platform truck 224 slidably engage and cooperate with the second platform guide rod 208. Platform trucks 221, 222, 223, and 224 are each disposed with bearings 226 which cooperate, respectively, with the first platform guide rod 206 and the second platform guide rod 208, thereby enabling the platform trucks 221, 222, 223, and 224, and thus the foot platform 192, to slidably translate smoothly along the first and second platform guide rods 206 and 208. The first and second platform trucks 221 and 222 and the third and fourth platform trucks 223 and 224 are configured to facilitate substantially frictionless motion by the foot platform 192 along the first and second platform guide rods 206 and 208, respectively.

In order to hold the foot platform 192 in the exercise start position of the machine 10, a pair of tubular stop arms 228 and 229 (FIG. 22) projects outwardly from the third vertical member 36 and the fourth vertical member 38, respectively. The first tubular stop arm 228 is securably mounted, such as by arc welding, perpendicularly from the rearward sidewall of third vertical member 36, proximate first tubular horizontal member 22. A second tubular stop arm 229 is securably mounted, such as by arc welding, perpendicularly from the rearward sidewall of fourth vertical member 38, proximate second tubular horizontal member 24. The first tubular stop arm 228 and second tubular stop arm 229 are coplanar. The first and second tubular stop arms 228 and 229 are oriented in transverse plane TP-1. An underside of the horizontal forward section 193 of foot platform 192 engages the first tubular stop arm 228 and second tubular stop arm 229 and holds the foot platform 192 in the exercise start position of the machine 10 illustrated in FIGS. 1, 24-26, 28, 33 and 35.

Referring now to FIGS. 1, 26, and 28-31, an adjustable load or resistance 240 is provided in the rear support section 230 of the main frame 15. The adjustable resistance 240 may be provided in many different forms, as will be understood by those skilled in the field, such as including, but not limited to, loadable weight plates, a weight stack, pneumatic or hydraulic resistance, electric or magnetic resistance, tension springs, bands or rods, or any other form of exercise resistance common in the field of exercise machines and equipment. In view of the resistance 240 being adjustable, the machine 10 of the present invention accommodates users of various levels of physical conditioning and ability.

In accordance to one embodiment, the adjustable resistance 240 comprises a weight stack 242 housed within a weight stack structure 250. The weight stack 242 is a standard selectorized weight stack as known in the field. The weight stack 242 comprises a plurality of plates 243, each preferably being the same weight. The weight stack 242 is operably connected with the shoulder support 120 and the upper torso support 50 via a suitable linking assembly 300 or system, shown herein as a cable and pulley assembly 302 comprising a cable 304 and a plurality of pulleys P-A through P-G for directing the cable 304. Other suitable linking systems known in the field are envisioned, such as a belt(s), chain(s), rope(s), tie rod(s), or arm(s), and as such, are within the spirit and scope of the present application.

The weight stack structure 250 comprises a first tubular horizontal member 251 and a second tubular horizontal member 252, the first and second tubular horizontal members 251 and 252 are coplanar and spatially aligned in a parallel orientation. Weight stack structure 250 includes a forward crossmember 254, and a rearward crossmember 256, wherein forward crossmember 254 is securably mounted, such as by arc welding, between respective inner sidewalls of the first tubular horizontal member 251 and the second tubular horizontal member 252 at forward ends 251*a* and 252*a*, respectively, thereof. Rearward crossmember 256 is securably mounted, such as by arc welding, between respective inner sidewalls of the first tubular horizontal member 251 and the second tubular horizontal member 252 about a midpoint of first and second tubular horizontal members 251 and 252. Weight stack structure 250 further includes a first vertical member 257 and a second vertical member 259, wherein the first vertical member 257 is securably mounted, such as by arc welding, to an upper sidewall of the first tubular horizontal member 251 at the forward end 251*a* thereof, and the second vertical member 259 is securably mounted, such as by arc welding, to an upper sidewall of the second tubular horizontal member 252 at the forward end 252*a* thereof. The first vertical member 257 and the second vertical member 259 extend vertically along the same transverse plane. A first short member 260 and a second short member 262 is disclosed, wherein the first short member 260 is securably mounted, such as by arc welding, along a forward end 260*a*, lower sidewall thereof superjacent a top edge of the first vertical member 257, and the second short member 262 is securably mounted, such as by arc welding, along a forward end 262*a*, lower sidewall thereof superjacent a top edge of the second vertical member 259. The first short member 260 and the second short member 262 are coplanar and lie in the same horizontal plane.

The weight stack structure 250 further includes a first elongated, vertically-disposed member 264 and a second elongated, vertically-disposed member 266. The first elongated, vertically-disposed member 264 is securably mounted, such as by arc welding, perpendicularly to the upper sidewall of the first tubular horizontal member 251, rearward to first vertical member 257, and the second elongated, vertically-disposed member 266 is securably mounted, such as by arc welding, perpendicularly to an upper sidewall of the second tubular horizontal member 252, rearward to second vertical member 259. The first elongated, vertically-disposed member 264 and the second elongated, vertically-disposed member 266 extend upwardly in parallel spaced relation. An upper crossmember 270 is securably mounted, such as by arc welding, between respective inner sidewalls of the first elongated, vertically-disposed member 264 and the second elongated, vertically-disposed member 266, proximately above rearward crossmember 256. A base member 272 is securably mounted, such as by arc welding, between respective inner sidewalls of the first elongated, vertically-disposed member 264 and the second elongated, vertically-disposed member 266, above upper crossmember 270 and orthogonal to first short member 260 and second short member 262. A top member 274 is securably mounted, such as by arc welding, superjacent upper ends of the first elongated, vertically-disposed member 264 and the second elongated, vertically-disposed member 266. The top member 274 includes a first rod aperture 275 and a second rod aperture 276, wherein the first rod aperture 275 is aligned in spaced relation to the second rod aperture 276. The first rod aperture 275 is defined through the upper sidewall of top member 274 and extends downward through the bottom sidewall thereof, and wherein second rod aperture 276 is defined through the upper sidewall of top member 274 and extends downward through the bottom sidewall thereof.

To stabilize the weight stack structure 250, a rear sidewall of the rearward crossmember 84 may be mounted to the forward sidewall of the forward crossmember 254 in a contiguous or flush arrangement. In accordance with one preferred embodiment, the rearward crossmember 84 is securably mounted, such as by arc welding, to the forward sidewall of the forward crossmember 254.

Adjustable feet 28 or footers may be provided along the lower sidewalls of each the first tubular horizontal member 251 and the second tubular horizontal member 252. The first and second tubular horizontal members 251 and 251 may each include a single adjustable foot 28 coupled at respective rear ends thereof, or the first and second tubular horizontal members 251 and 251 may each include two adjustable feet 28 coupled respectively to the lower sidewalls thereof, wherein one adjustable foot 28 coupled respectively at forward ends thereof, and one adjustable foot 28 coupled respectively at rear ends thereof.

Figure 29:
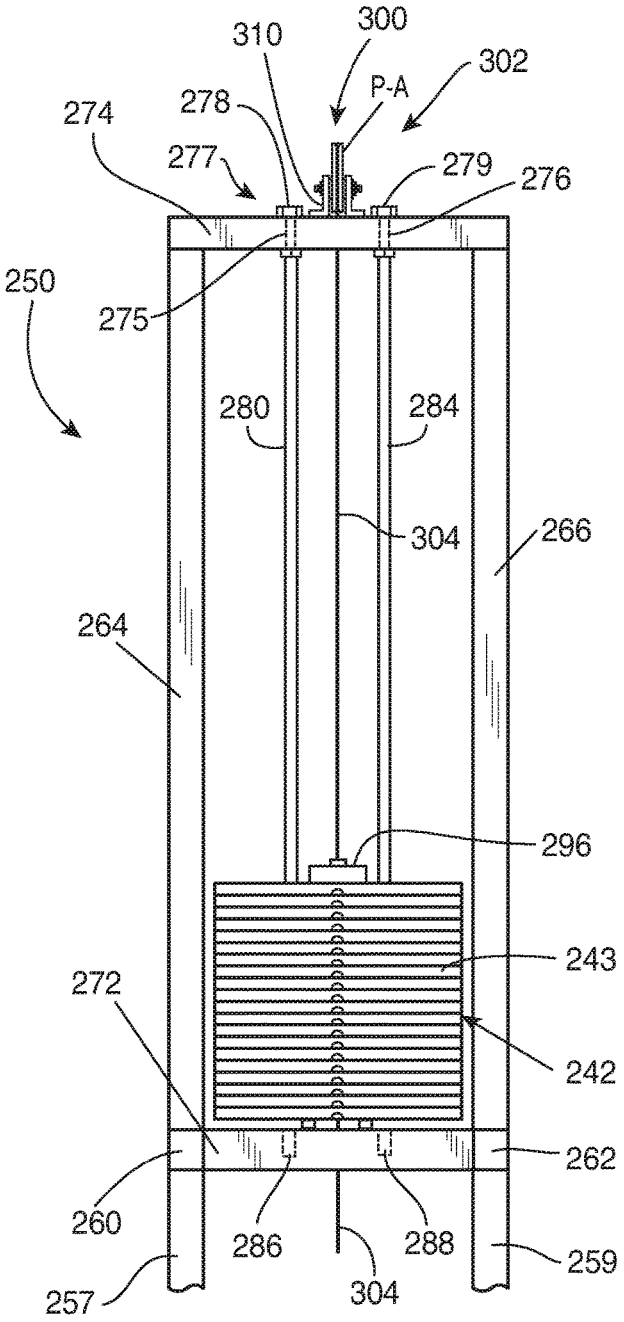
FIG. 29 is a front end elevational view of a weight stack structure housing a selectorized weight stack, in accordance to one embodiment of the present invention.
Figure 31:
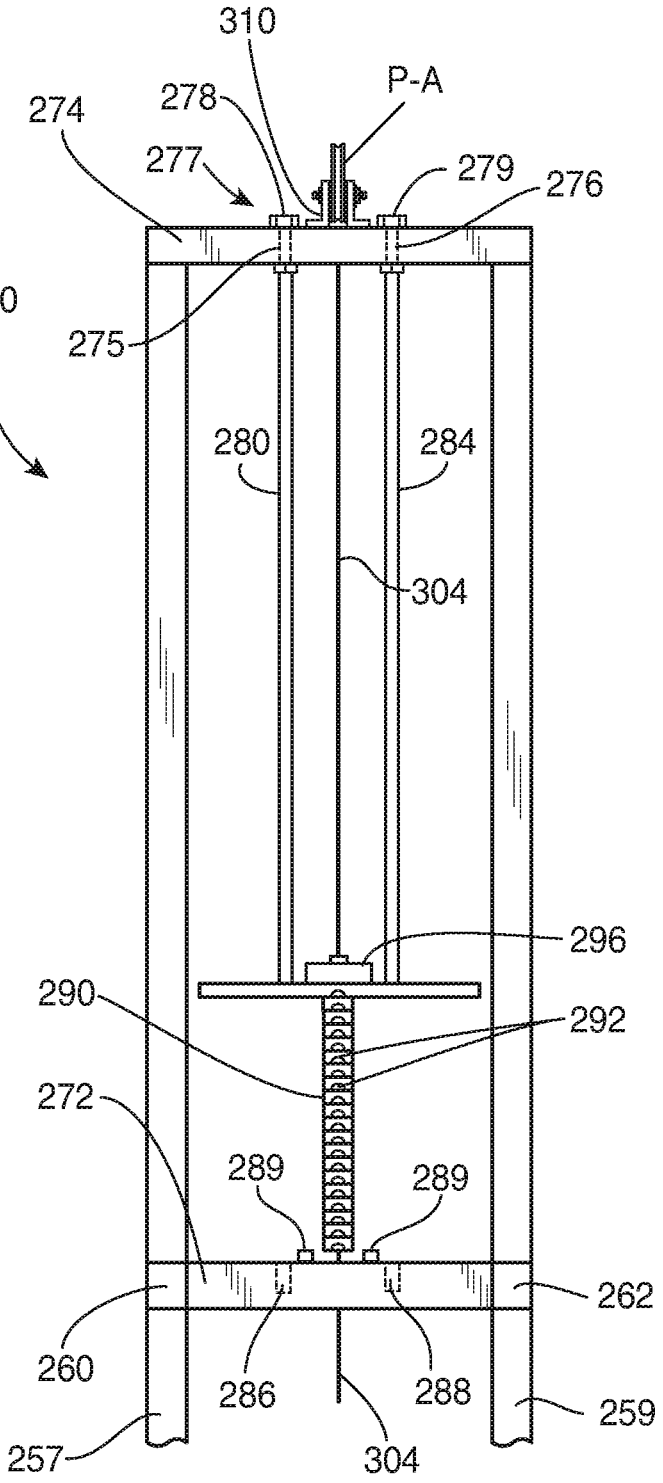
FIG. 31 is a front end elevational view of the weight stack structure in FIG. 29 shown with the weight stack removed illustrating a weight selection bar.

Referring now more particularly to the cable and pulley assembly 302, the assembly 302 further comprises an upper pulley mounting bracket 310 (as best shown in FIGS. 29 and 31) extending upwardly from an upper sidewall of the top member 274 of the weight stack structure 250. The upper pulley mounting bracket 310 is securably mounted, such as by arc welding, superjacent the upper sidewall of top member 274. For purposes of brevity and obviating redundancy, the foregoing pulley mounting brackets 312, 314, 316, 318, 320, and 322 may all be securably mounted to corresponding frame elements and components of the present invention, as described hereinafter, via arc welding. The upper pulley mounting bracket 310 pivotally supports a plates lift pulley P-A (FIGS. 26, 29, and 31) such as via a retention pin or other suitable fastener for pivotally supporting pulley P-A in a pivotally secured manner. An axially-aligned hole 306, defined through the lower sidewall and extending through the upper sidewall of top member 274 allows passage of the cable 304 therethrough and which extends around the plates lift pulley P-A.

Figure 27:
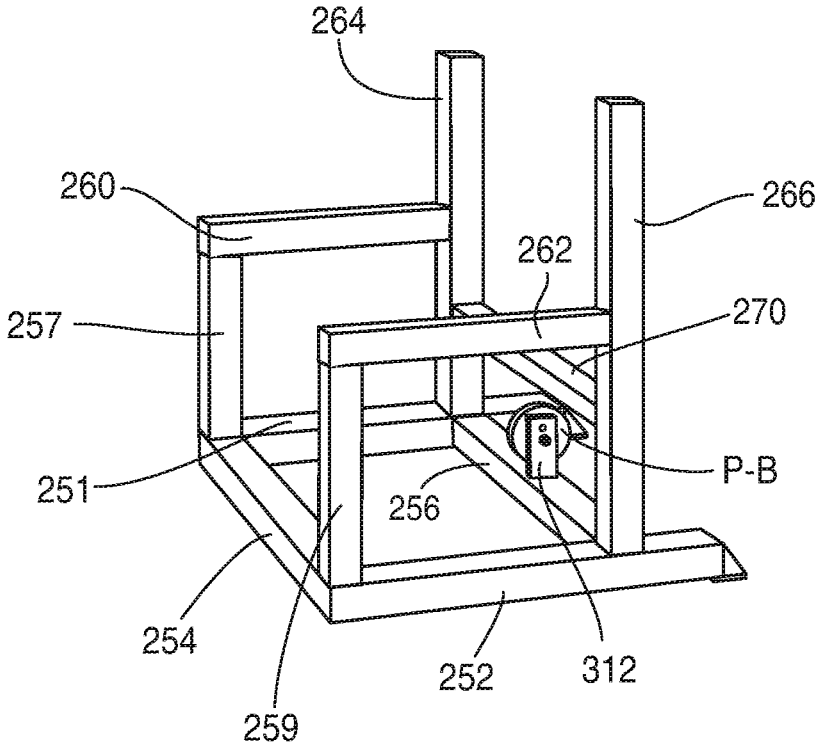
FIG. 27 is a left side perspective view showing the lower section of a weight stack structure, in accordance with one embodiment of the present invention.
Figure 28:
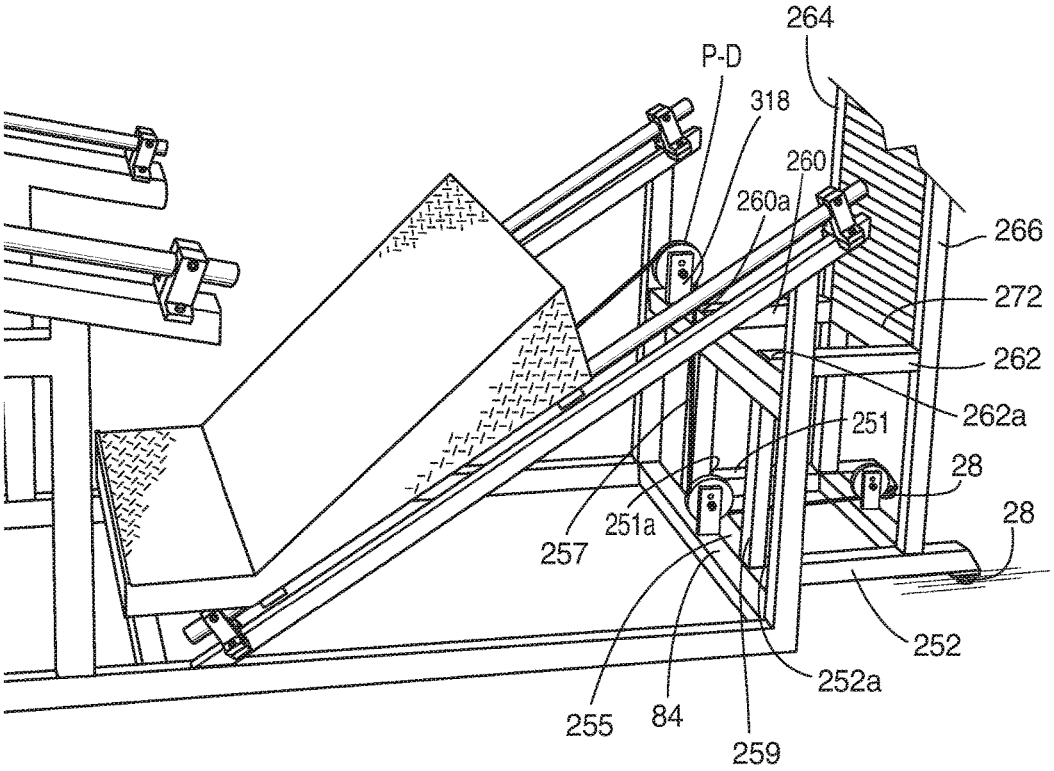
FIG. 28 is a partial left side perspective view of the central support section and the rear support section of the main frame illustrating an upper central support pulley pivotally supported by an upper central support section bracket, in accordance to one embodiment of the present invention.
Figure 30:
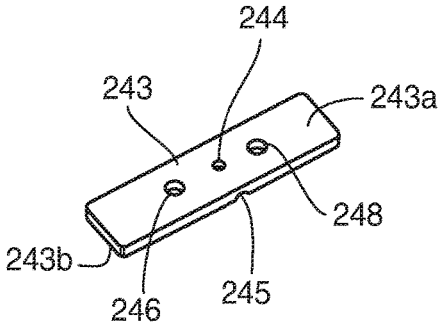
FIG. 30 is a perspective view of one weight plate of a weight stack, in accordance to one embodiment of the present invention.
Figure 32:
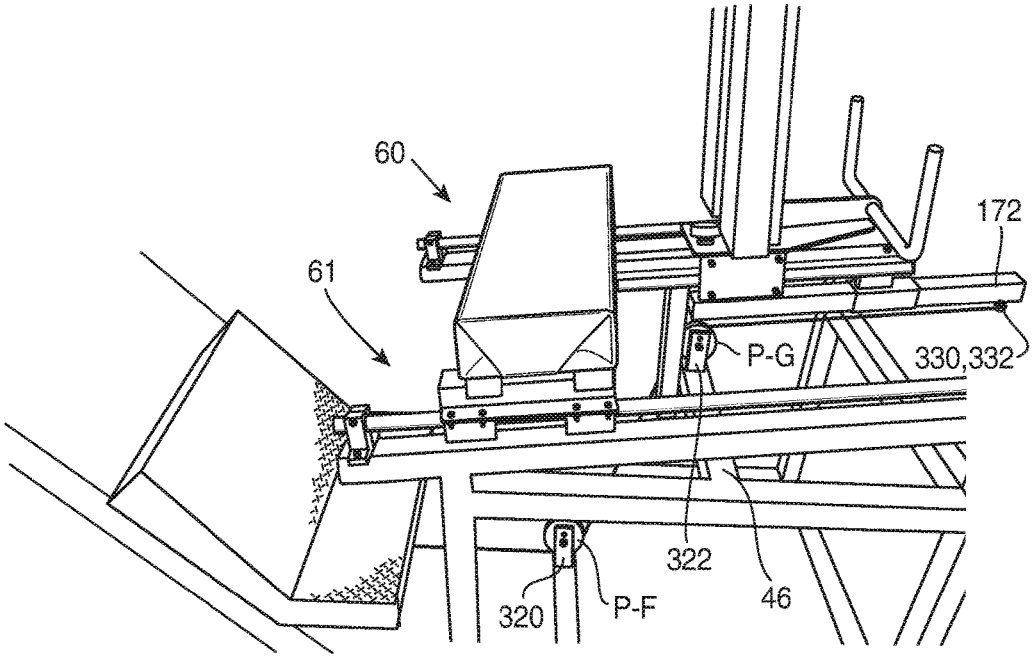
FIG. 32 is a partial right side perspective view of the front support section and the central support section illustrating a lower front support section pulley pivotally supported by a lower front support section bracket, and an upper front support section pulley pivotally supported by an upper front support section bracket, in accordance to one embodiment of the present invention.

A lower rear support section bracket 312 (FIG. 27) is securably mounted superjacent the upper sidewall of the rearward crossmember 256 of weight stack structure 250. The lower rear support section bracket 312 pivotally supports a lower rear support section pulley P-B (FIG. 27) in a secured fashion. A first lower central support section bracket 314 having an L-shaped configuration (FIGS. 22 and 26) is securably mounted to the forward sidewall of forward crossmember 82. The first lower central support section bracket 314 pivotally supports a first lower central support section pulley P-C (FIGS. 22 and 26) in a secured fashion. A second lower central support section bracket 316 having an L-shaped configuration (FIG. 22) is securably mounted superjacent the upper sidewall of rearward crossmember 84. The second lower central support section bracket 316 pivotally supports a second lower central support section pulley P-E (FIG. 22) in a secured fashion. An upper central support section bracket 318 (FIG. 28) is securably mounted to a rearward sidewall of upper crossmember 86. The upper central support section bracket 318 pivotally supports an upper central support pulley P-D (FIG. 28) in a secured fashion. A lower front support section bracket 320 (FIG. 32) is securably mounted superjacent the upper sidewall of second lower crossmember 26. The lower front support section bracket 320 pivotally supports a lower front support section pulley P-F (FIG. 32) in a secured fashion. An upper front support section bracket 322 (FIG. 32) is securably mounted superjacent the upper sidewall of second upper tubular crossmember 46. The upper front support section bracket 322 pivotally supports an upper front support section pulley P-G (FIG. 32) in a secured fashion.

In reference to FIGS. 1, and 26-32, a first weight stack guide rod 280 and a second weight stack guide rod 284 extend vertically in parallel spaced relation between the first elongated, vertically-disposed member 264 and the second elongated, vertically-disposed member 266. Upper ends of each the first weight stack guide rod 280 and the second weight stack guide rod 284 are received by the first rod aperture 275 and a second rod aperture 276, respectively, and the upper ends of rods 280 and 284 are secured to the top member 274 via suitable mechanical fasteners 277, such as nuts 278 and 279, bolts and nuts, respectively. Lower ends of the first weight stack guide rod 280 and the second weight stack guide rod 284 may be received in spatially-aligned detents 286 and 288, respectively, disposed in the base member 272. The first weight stack guide rod 280 and the second weight stack guide rod 284 support the plurality of plates 243 in the weight stack 242 so that the plates 243 slide up and down the first weight stack guide rod 280 and the second weight stack guide rod 284 when the user of the present invention is performing an exercise. Resilient shock absorbing members 289 may be disposed between the lowermost plate 243 in the weight stack 242 and the base member 272 to lessen the impact when the plates 243 are lowered. In accordance to one embodiment, the shock absorbing members 289 are coupled spatially to an upper sidewall of base member 272.

Each plate 243 further comprises a first weight stack guide rod aperture 246 and a second weight stack guide rod aperture 248 extending between a top face 243*a* of the plate 243 to a bottom face 243*b* of the plate 243, wherein the first weight stack guide rod aperture 246 and the second weight stack guide rod aperture 248 are adapted to cooperate with the first weight stack guide rod 280 and the second weight stack guide rod 284, respectively. Each plate 243 comprises a bar receiving hole 244 defined centrally therethrough between the first and second weight stack guide rod apertures 246 and 248. Each plate 243 further comprises a weight pin receiving aperture 245 extending generally transversely from the bar receiving hole 244. A weight selection bar 290 extends through the bar receiving hole 244 of each of the plurality of plates 243 in the weight stack 242. The weight selection bar 290 has a series of holes 292 disposed along its length. Each of the holes 292 corresponds in position to the position of a plate 243 in the weight stack 242. One end of the cable 304 of the cable and pulley assembly 302 is coupled to the uppermost plate 243 in the weight stack 242 by a coupling member 296 mounted to an upper end of the weight selection bar 290.

The cable 304 extends upwardly from the coupling member 296, through the axially-aligned hole 306 of top member 274 and extends over, or is otherwise routed over, and engages pulley P-A. From pulley P-A, the cable 304 extends downward and extends under and engages pulley P-B from which cable 304 extends forwardly in a generally horizontal course and extends under and then over engaging pulley P-C in a rearward course, and from pulley P-C, the cable 304 extends rearward inclinationally or in a sloped course and extends over pulley P-D and downward therefrom and extends under and engages pulley P-E from which cable 304 extends forwardly in a generally horizontal course and extends under and engages pulley P-F, from which cable 304 extends in a generally upward course and extends over and engages pulley P-G, from which cable 304 extends in a forward sloped course and terminates at an anchor 330, shown in FIG. 32 as an eyebolt 332 fixedly coupled to the lower sidewall of the tubular shaft 172, proximate a forward end thereof. As illustrated, the terminal end of cable 304 is fixedly coupled to the anchor 330.

In order to select the desired amount of weight for performing an exercise, a weight selection pin 294 is inserted through the weight pin receiving aperture 245 to engage the weight selection bar 290, which thereby engages the plate 243 associated with the selected weight pin receiving aperture 245. For example, if the user selects the $5^{th}$ plate from a top of the weight stack 242, the user will lift the $5^{th}$ plate and the four plates 243 above it during the exercise. The selected plate 243 and all of the plates 243 thereabove are lifted by the cable 304. Thus, the user may gradually increase or decrease the amount of weight lifted when performing the exercise.

The machine 10 can also be used to enhance strength training regimens, particularly concerning rehabilitation therapy for the lower lumbar and knees.

Figure 33:
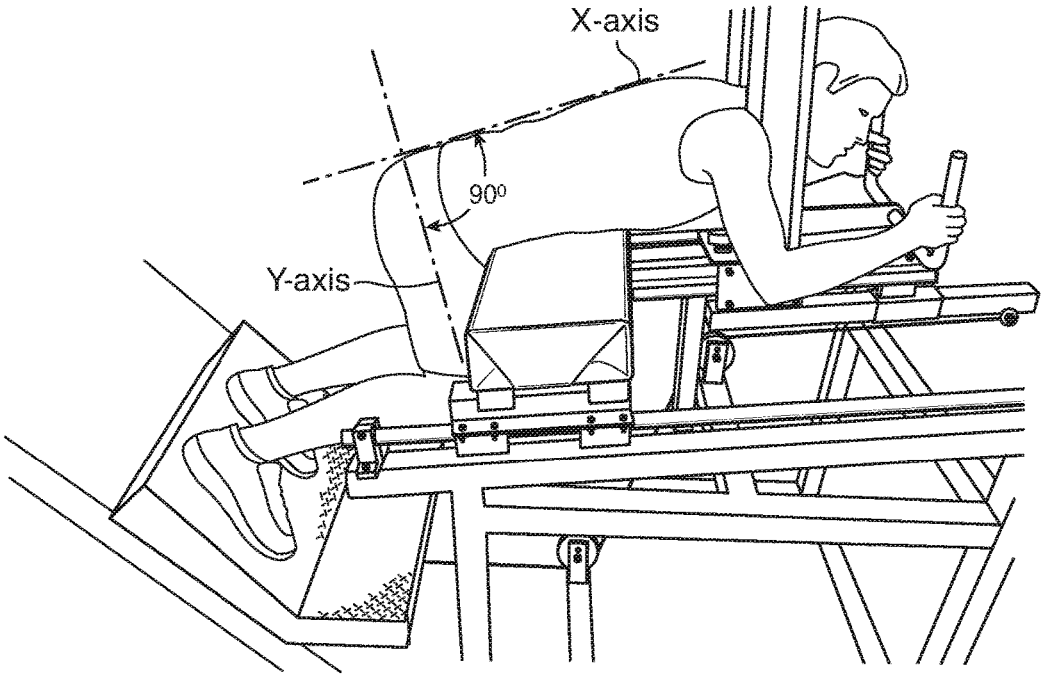
FIG. 33 is a right perspective view of a user shown in the proper exercise start position, whereby user's hip flexion measures 90°.
Figure 34:
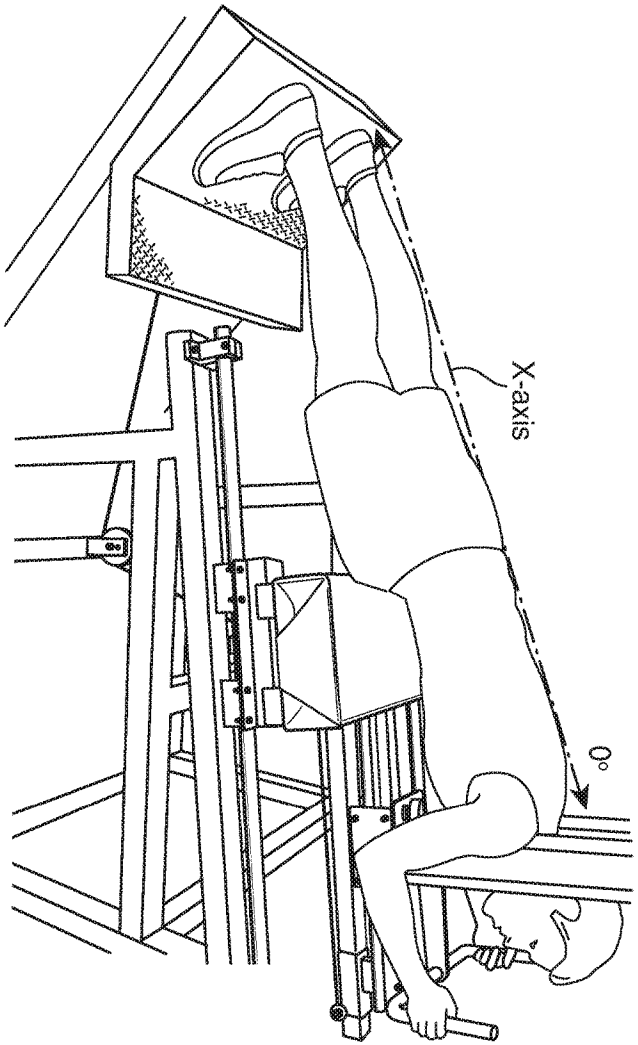
FIG. 34 is a right perspective view of the user in FIG. having completed one-half of a single repetition, whereby user's hip flexion measures 0°.
Figure 35:
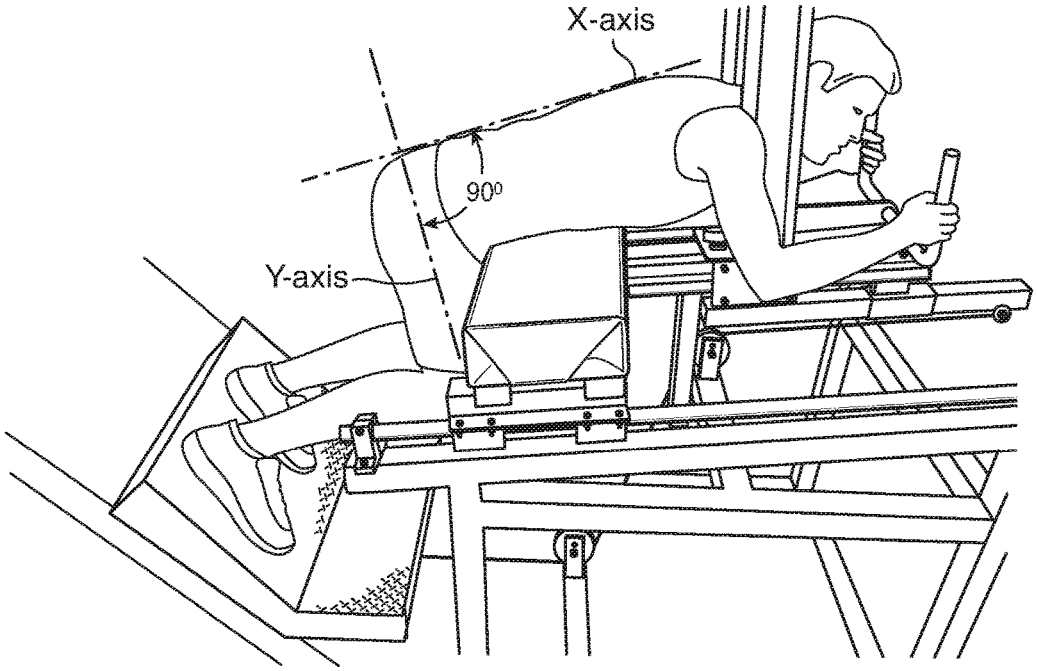
FIG. 35 is a right perspective view of the user in FIG. 34 having completed one full repetition of the exercise, whereby user's hip flexion measures 90°.

Referring now to FIGS. 33-35, to use the machine 10, user begins the lower torso exercise movement in a prone and anatomic athletic position atop the cushioned pad 51, feet (or balls of feet) positioned on the foot engaging section 199 of foot platform 192, shoulders engaged against shoulder pads 122, user grasps the hand grips 144, and user knee and hip joints are oriented at 90°, whereby a significant proportion of user's body weight is dispersed on the ventral surface proximate the navel, thereby supporting user body weight predominately opposite the lumbar spine (relieving stress on the lumbar spine). In the event user hip flexion measure is less than or greater than 90° in the exercise start position, user slidably adjusts the shoulder pads 122 longitudinally until user acquires 90° hip flexion in the exercise start position. Once user's knee and hip joints are oriented at 90° (as depicted in FIG. 33), user next extends legs (causing concurrent slidable translation by the inclined upper torso support 50 in a linear, upward inclined path and the foot platform 192 in a linear, upward declined path) to a fully extended position at which user knee and hip joints are oriented at 0° (as depicted in FIG. 34), user bends legs back to the starting position (causing concurrent slidable translation by the inclined upper torso support 50 in a linear, downward inclined path and the foot platform 192 in a linear, downward declined path) at which user knee and hip joints are oriented at 90° (as depicted in FIG. 35), which completes one (1) full movement (or repetition) of the exercise, the movement performed by user through the biomechanically optimal range of motion, during which user hip flexion never exceeds 90°, and thereby substantially limiting or eliminating damage to joints, particularly knees, and the lumbar spine.

It is envisioned that the various embodiments, as separately disclosed, are interchangeable in various aspects, so that elements of one embodiment may be incorporated into one or more of the other embodiments, and that specific positioning of individual elements may necessitate other arrangements not specifically disclosed to accommodate performance requirements or spatial considerations.

It is to be understood that the embodiments and claims are not limited in its application to the details of construction and arrangement of the components set forth in the description and illustrated in the drawings. Rather, the description and the drawings provide examples of the embodiments envisioned, but the claims are limited to the specific embodiments. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the U.S. Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

What is claimed is:

1. An exercise machine comprising:

a main frame comprising a front support section, a central support section, and a rear support section, the front support section and the rear support section are integrally joined by the central support section, wherein the front support section comprises:

a carriage support base;

a torso carriage assembly, the torso carriage assembly is mechanically coupled superjacent the carriage support base;

an adjustable, inclined upper torso support, the adjustable, inclined upper torso support is slidably coupled to the torso carriage assembly, the adjustable, inclined upper torso support slidably translates bi-directionally along the torso carriage assembly in a linear, inclined path;

a track assembly comprising a track support plate and an elongated track, the elongated track is mounted atop the track support plate, the track support plate is securably mounted to the inclined upper torso support; and an adjustable shoulder support, the adjustable shoulder support being slidably coupled to the track assembly;

the central support section comprises:

a foot support carriage; and a foot support assembly, the foot support assembly is mechanically coupled superjacent the foot support carriage, the foot support assembly slidably translates bi-directionally along the foot support carriage in a linear, declined path; and the rear support section comprises:

an adjustable resistance operably connected with the adjustable shoulder support and the adjustable, inclined upper torso support via a linking assembly.

2. The exercise machine of claim 1, further comprising:

an adjustable pads support plate, the adjustable pads support plate being slidably coupled to the track assembly, the adjustable shoulder support is mounted perpendicularly atop the adjustable pads support plate; and hand grips, the hand grips are securably mounted to the adjustable pads support plate via a hand grips support bracket.

3. An exercise apparatus comprising:

a main frame comprising a front support section, a central support section, and a rear support section, the front support section and the rear support section are integrally joined by the central support section, wherein the front support section comprises:

a carriage support base;

a torso carriage assembly, the torso carriage assembly is mechanically coupled superjacent the carriage support base;

an adjustable, inclined upper torso support, the adjustable, inclined upper torso support includes a pad platform and a cushioned pad, the cushioned pad overlies the pad platform, the adjustable, inclined upper torso support is slidably coupled to the torso carriage assembly, the inclined upper torso support slidably translates bi-directionally along the torso carriage assembly in a linear, inclined path;

a track assembly comprising a track support plate and an elongated track, the elongated track is mounted atop the track support plate, the track support plate is securably mounted to the inclined upper torso support; and an adjustable shoulder support, the adjustable shoulder support being slidably coupled to the track assembly;

the central support section comprises:

a foot support carriage; and a foot support assembly, the foot support assembly is mechanically coupled superjacent the foot support carriage, the foot support assembly slidably translates bi-directionally along the foot support carriage in a linear, declined path; and wherein the rear support section comprises:

an adjustable resistance operably connected with the adjustable shoulder support and the adjustable, inclined upper torso support via a linking assembly.

4. The exercise apparatus of claim 3, wherein the foot support assembly comprises a foot platform, the foot platform comprising:

a horizontal forward section having opposing downwardly depending sidewalls, an open front end, and a forward edge from which a raised lip extends integrally a length there down; and a foot engaging section having opposing downwardly depending, conical-shaped sidewalls and a rear sidewall, the foot engaging section extends integrally from the horizontal forward section.

5. The exercise apparatus of claim 4, wherein the foot engaging section and the adjustable, inclined upper torso support slidably translate in a concurrent manner during user operation of the exercise apparatus.

6. The exercise apparatus of claim 5, wherein the foot engaging section slidably translates bi-directionally along the foot support carriage in a linear, declined path at an angle measuring in a range of 122.5° to 137.5°, the adjustable, inclined upper torso support slidably translates bi-directionally along the torso carriage assembly in a linear, inclined path at an angle measuring in a range of 98° to 102°, thereby enabling user's hip flexion to measure 90° at an exercise start position, to measure 0° at the user's completion of one-half of a single repetition, and to measure 90° at the user's completion of one full repetition of the exercise.

7. The exercise apparatus of claim 6, wherein the foot engaging section and the adjustable, inclined upper torso support slidably translate smoothly and in a frictionless manner.

8. The exercise apparatus of claim 6, wherein the foot engaging section and the adjustable, inclined upper torso support slidably translate bi-directionally in linear paths at respective angles.

9. The exercise apparatus of claim 4, wherein the foot engaging section of the foot platform slidably translates bi-directionally along the foot support carriage in a linear, declined path at an angle measuring in a range of 115° to 145°.

10. The exercise apparatus of claim 3, wherein the inclined upper torso support slidably translates bi-directionally along the torso carriage assembly in a linear, inclined path at an angle measuring in a range of 95° to 105°.

* * * * *